US012151798B2

(12) United States Patent
Schmid et al.

(10) Patent No.: US 12,151,798 B2
(45) Date of Patent: Nov. 26, 2024

(54) SYSTEM AND METHOD FOR POSITIONING AN AQUATIC VESSEL

(71) Applicants: Polaris Industries Inc., Medina, MN (US); Carnegie Mellon University, Pittsburgh, PA (US)

(72) Inventors: Andrew C. Schmid, Brooklyn Park, MN (US); Michael J. Fuchs, Blaine, MN (US); Blair A. Donat, Elkhart, IN (US); Gabriel A. Marshall, Three Rivers, MI (US); Bradley R. Fishburn, Nappanee, IN (US); Herman Herman, Gibsonia, PA (US); Prasanna Kannappan, Pittsburgh, PA (US); Matthew Glisson, Pittsburgh, PA (US); Krishna Pandravada, Pittsburgh, PA (US); Suryansh Saxena, Pittsburgh, PA (US); Louis Hiener, Pittsburgh, PA (US); Nishant Pol, Pittsburgh, PA (US); Gabriel Goldman, Pittsburgh, PA (US); Karl Muecke, Pittsburgh, PA (US)

(73) Assignees: Polaris Industries Inc., Medina, MN (US); Carnegie Mellon University, Pittsburgh, PA (US)

( * ) Notice: Subject to any disclaimer, the term of this patent is extended or adjusted under 35 U.S.C. 154(b) by 872 days.

(21) Appl. No.: 17/033,805

(22) Filed: Sep. 27, 2020

(65) Prior Publication Data

US 2021/0094665 A1 Apr. 1, 2021

Related U.S. Application Data

(60) Provisional application No. 63/012,992, filed on Apr. 21, 2020, provisional application No. 62/907,250, filed on Sep. 27, 2019.

(51) Int. Cl.
*B63H 25/04* (2006.01)
*B63B 49/00* (2006.01)
(Continued)

(52) U.S. Cl.
CPC ..... *B63H 25/04* (2013.01); *B63B 49/00* (2013.01); *B63H 25/46* (2013.01); *B63H 2025/028* (2013.01)

(58) Field of Classification Search
CPC .. B63H 25/04; B63H 25/46; B63H 2025/028; B63H 11/04; B63B 49/00; B63B 1/125; B63B 29/02; B63B 35/34
See application file for complete search history.

(56) References Cited

U.S. PATENT DOCUMENTS 4,056,073 A 11/1977 Dashew et al.
5,172,324 A 12/1992 Knight
(Continued)

FOREIGN PATENT DOCUMENTS

CA 2396479 A1 10/2003
CN 104276265 A 1/2015
(Continued)

OTHER PUBLICATIONS

International Search Report and Written Opinion, issued by the International Searching Authority, dated Dec. 21, 2020, for International Patent Application No. 3; 9 pages.
(Continued)

*Primary Examiner* — Richard M Camby
(74) *Attorney, Agent, or Firm* — Faegre Drinker Biddle & Reath LLP

(57) ABSTRACT

An aquatic vessel, illustratively a pontoon boat including a thruster system is disclosed. The aquatic vessel executes a process to automatically position the aquatic vessel relative
(Continued)

to a target location such as a mooring implement. Exemplary mooring implements include a dock, a slip, or a lift.

25 Claims, 23 Drawing Sheets

(51) Int. Cl.
*B63H 25/46* (2006.01)
*B63H 25/02* (2006.01)

(56) References Cited

U.S. PATENT DOCUMENTS 5,259,331 A 11/1993 Hagan
5,502,587 A 3/1996 Frigo
6,142,841 A 11/2000 Alexander et al.
6,249,241 B1 * 6/2001 Jordan ..... G01S 13/917 342/41
6,325,683 B1 12/2001 Yocom
6,434,512 B1 * 8/2002 Discenzo ..... F16C 41/008 702/184
6,439,941 B2 8/2002 McClure
6,469,664 B1 10/2002 Michaelson
6,581,537 B2 6/2003 McBride
6,734,808 B1 5/2004 Michaelson
7,182,033 B1 2/2007 Phillips
7,185,599 B1 3/2007 Griffiths
7,315,779 B1 1/2008 Rioux et al.
7,380,538 B1 6/2008 Gagnon et al.
7,416,458 B2 8/2008 Suemori
7,530,345 B1 5/2009 Plante et al.
7,836,787 B2 11/2010 Oguma
7,841,915 B2 11/2010 Bourret et al.
7,900,510 B1 * 3/2011 O'Brien ..... G01C 5/06 73/295
7,950,340 B1 5/2011 Curtis
8,066,538 B1 * 11/2011 Kostrzewski ..... B63H 11/107 114/151
8,146,524 B1 4/2012 Cote et al.
8,177,594 B2 5/2012 Dagenais et al.
8,202,136 B2 6/2012 Dagenais et al.
8,441,956 B2 5/2013 Misumi et al.
8,589,004 B1 11/2013 Kanno
8,622,778 B2 1/2014 Tyers
8,645,012 B2 2/2014 Salmon
8,725,312 B2 5/2014 Mori et al.
8,753,154 B2 6/2014 Fujino et al.
8,818,587 B1 8/2014 Arbuckle et al.
8,924,054 B1 12/2014 Arbuckle et al.
8,965,606 B2 2/2015 Mizutani
9,108,710 B1 8/2015 McChesney
9,248,895 B1 2/2016 Gendron et al.
9,376,189 B1 6/2016 De et al.
9,517,826 B1 12/2016 Leblond
9,682,757 B1 6/2017 Bourret
9,738,364 B2 8/2017 Abney
9,778,657 B2 * 10/2017 Tyers ..... G01C 21/203
10,065,721 B1 9/2018 Girard et al.
10,272,977 B2 4/2019 Hashizume
10,281,917 B2 5/2019 Tyers
10,377,458 B1 8/2019 McGinley
10,556,642 B1 2/2020 Massicotte et al.
10,723,429 B1 7/2020 Wiatrowski et al.
10,871,775 B2 12/2020 Hashizume et al.
11,046,406 B1 6/2021 Kunanec et al.
11,208,188 B2 12/2021 Fishburn et al.
11,348,191 B2 5/2022 Tian et al.
11,390,262 B2 7/2022 Brandt et al.
11,427,284 B1 8/2022 Lieb
11,618,537 B2 4/2023 Schmid et al.
11,738,841 B2 8/2023 Fishburn
2002/0129410 P1 9/2002 Amorao et al.
2003/0137445 A1 7/2003 Van Rees
2004/0222902 A1 11/2004 Wortsmith
2005/0181687 A1 8/2005 Okumura
2005/0272322 A1 * 12/2005 Mizuguchi ..... B63H 20/12 440/61 R
2006/0228959 A1 10/2006 Ruiz
2007/0227429 A1 10/2007 Okuyama et al.
2007/0249244 A1 10/2007 Watanabe et al.
2007/0276563 A1 11/2007 Kaji
2008/0038967 A1 2/2008 Shinde et al.
2008/0119094 A1 5/2008 Mizutani
2008/0254689 A1 10/2008 Kaji
2009/0101056 A1 4/2009 Waldo
2009/0107377 A1 4/2009 Duquette et al.
2009/0107379 A1 4/2009 Duquette et al.
2009/0107380 A1 4/2009 Duquette et al.
2009/0139437 A1 6/2009 Simard et al.
2009/0176418 A1 7/2009 Mizutani
2009/0224132 A1 9/2009 Mochizuki
2009/0227157 A1 9/2009 Mochizuki
2009/0264029 A1 10/2009 Dagenais et al.
2010/0041286 A1 2/2010 Bourret et al.
2010/0114412 A1 5/2010 Mizutani
2010/0178815 A1 7/2010 Leblanc
2010/0240266 A1 9/2010 Shibayama et al.
2010/0256845 A1 10/2010 Mizutani et al.
2010/0267296 A1 10/2010 Kuriyagawa et al.
2011/0217886 A1 9/2011 Kuriyagawa et al.
2011/0217888 A1 9/2011 Kuriyagawa et al.
2011/0223815 A1 9/2011 Kinoshita
2011/0294370 A1 12/2011 Kuriyagawa et al.
2012/0021659 A1 1/2012 Ota
2012/0025965 A1 2/2012 Mochizuki et al.
2012/0129410 A1 5/2012 Tyers
2013/0316603 A1 11/2013 Hagi
2014/0158037 A1 6/2014 George
2014/0220837 A1 8/2014 Kuriyagawa et al.
2014/0295717 A1 10/2014 Kuriyagawa et al.
2014/0349530 A1 11/2014 Mochizuki et al.
2014/0364019 A1 12/2014 Ito et al.
2015/0086373 A1 3/2015 Kaneko et al.
2015/0089427 A1 3/2015 Akuzawa
2016/0003636 A1 1/2016 Ng-Thow-Hing et al.
2016/0011000 A1 1/2016 Vanderburgh
2016/0059855 A1 3/2016 Rebhan et al.
2016/0176409 A1 6/2016 Kirsch et al.
2016/0187883 A1 6/2016 Tyers et al.
2016/0318445 A1 11/2016 Sugimoto
2016/0375974 A1 12/2016 Loftus et al.
2017/0137103 A1 5/2017 Ito
2017/0152012 A1 6/2017 Vachon
2017/0205829 A1 * 7/2017 Tyers ..... B63H 25/04
2017/0268896 A1 9/2017 Bai et al.
2017/0277192 A1 9/2017 Gupta et al.
2017/0369055 A1 12/2017 Saigusa et al.
2018/0004209 A1 1/2018 Akuzawa et al.
2018/0017974 A1 * 1/2018 Tyers ..... G01S 19/13
2018/0037227 A1 2/2018 Dsa et al.
2018/0134354 A1 5/2018 Suzuki et al.
2018/0151009 A1 5/2018 Kim et al.
2018/0283874 A1 10/2018 Hashizume et al.
2018/0286251 A1 10/2018 Fujima
2018/0288821 A1 10/2018 Kanayama et al.
2018/0345994 A1 12/2018 Goerick
2019/0019352 A1 1/2019 Harper
2019/0048639 A1 2/2019 Lickfelt et al.
2019/0071160 A1 3/2019 Bylsma et al.
2019/0233074 A1 8/2019 Wiatrowski et al.
2020/0001953 A1 1/2020 Vachon et al.
2020/0026293 A1 1/2020 Hashizume et al.
2020/0042013 A1 2/2020 Kelkar et al.
2020/0064466 A1 2/2020 Harper et al.
2020/0086879 A1 3/2020 Lakshmi et al.
2020/0089969 A1 3/2020 Lakshmi et al.
2020/0156751 A1 5/2020 Skrzypchak et al.
2020/0252775 A1 8/2020 Morschhauser et al.
2020/0301437 A1 9/2020 Misu et al.
2020/0312155 A1 10/2020 Kelkar et al.
2020/0385097 A1 12/2020 Fishburn
2021/0061431 A1 3/2021 McGinley et al.
2021/0065224 A1 3/2021 Kawashima
2021/0086875 A1 3/2021 Nakatani

(56) References Cited

U.S. PATENT DOCUMENTS

| | | | |
|---|---|---|---|
| 2021/0094661 | A1 | 4/2021 | Schmid et al. |
| 2021/0129954 | A1 | 5/2021 | Inoue |
| 2021/0141396 | A1 | 5/2021 | Kinoshita |
| 2021/0155333 | A1 | 5/2021 | Mizutani |
| 2021/0188406 | A1 | 6/2021 | Nakatani |
| 2021/0229791 | A1 | 7/2021 | Inoue |
| 2021/0250737 | A1 | 8/2021 | Herga et al. |
| 2021/0263513 | A1 | 8/2021 | Liu et al. |
| 2021/0293545 | A1 | 9/2021 | Zhang et al. |
| 2021/0335060 | A1 | 10/2021 | Bauer et al. |
| 2021/0380210 | A1 | 12/2021 | Fishburn et al. |
| 2022/0001962 | A1 | 1/2022 | Krosschell et al. |
| 2022/0048513 | A1 | 2/2022 | Xu et al. |
| 2022/0169339 | A1 | 6/2022 | Jaziri et al. |
| 2022/0177087 | A1 | 6/2022 | Amma et al. |
| 2022/0177088 | A1 | 6/2022 | Amma |
| 2022/0234701 | A1 | 7/2022 | Suda |
| 2022/0306256 | A1 | 9/2022 | Ohiso |
| 2022/0306257 | A1 | 9/2022 | Afman et al. |
| 2022/0308576 | A1 | 9/2022 | Judson et al. |
| 2022/0317857 | A1 | 10/2022 | Tarchala et al. |
| 2022/0332303 | A1 | 10/2022 | Bernatchez et al. |
| 2022/0371700 | A1 | 11/2022 | Hall et al. |
| 2022/0371715 | A1 | 11/2022 | Ito |
| 2022/0383646 | A1 | 12/2022 | Hosoya et al. |
| 2023/0008091 | A1 | 1/2023 | Tsubone et al. |
| 2023/0012090 | A1 | 1/2023 | Tsubone et al. |
| 2023/0049367 | A1 | 2/2023 | Endrizzi et al. |
| 2023/0168678 | A1 | 6/2023 | Kameyama et al. |
| 2023/0373606 | A1 | 11/2023 | Fishburn et al. |

FOREIGN PATENT DOCUMENTS

| | | | |
|---|---|---|---|
| CN | 109285389 | A | 1/2019 |
| ES | 2046117 | A2 | 1/1994 |
| JP | 59-073387 | A | 4/1984 |
| JP | 61-282193 | A | 12/1986 |
| JP | 05-065098 | A | 3/1993 |
| JP | 06-227478 | A | 8/1994 |
| JP | H0747992 | | 2/1995 |
| JP | 08-029745 | A | 2/1996 |
| JP | 08-032523 | A | 2/1996 |
| JP | 08-032524 | A | 2/1996 |
| JP | 08-032525 | A | 2/1996 |
| JP | 08-032528 | A | 2/1996 |
| JP | 08-284705 | A | 10/1996 |
| JP | 08-284725 | A | 10/1996 |
| JP | 08-284726 | A | 10/1996 |
| JP | 09-053500 | A | 2/1997 |
| JP | 09-301279 | A | 11/1997 |
| JP | 10-218084 | A | 8/1998 |
| JP | 2836738 | B2 | 12/1998 |
| JP | 2898502 | B2 | 6/1999 |
| JP | 2000-038195 | A | 2/2000 |
| JP | 2001-287693 | A | 10/2001 |
| JP | 3305522 | B2 | 7/2002 |
| JP | 3410867 | B2 | 5/2003 |
| JP | 3523711 | B2 | 4/2004 |
| JP | 2004-178574 | A | 6/2004 |
| JP | 3672133 | B2 | 7/2005 |
| JP | 2006-036008 | A | 2/2006 |
| JP | 3744961 | B2 | 2/2006 |
| JP | 3745406 | B2 | 2/2006 |
| JP | 2006-160214 | A | 6/2006 |
| JP | 2006-219002 | A | 8/2006 |
| JP | 3939777 | B2 | 7/2007 |
| JP | 4791340 | B2 | 10/2011 |
| JP | 2012-096774 | A | 5/2012 |
| JP | 2015-068831 | A | 4/2015 |
| JP | 2015-069656 | A | 4/2015 |
| KR | 10-2016-0006943 | | 1/2016 |
| WO | 2005/030574 | A1 | 4/2005 |
| WO | 2016/166620 | | 10/2016 |
| WO | 2018/232376 | | 12/2018 |
| WO | 2019/081019 | | 5/2019 |
| WO | 2021/075319 | A1 | 4/2021 |

OTHER PUBLICATIONS

Hummingbird.com, 2019 Hummingbird Products brochure; 40 pages.

Faria Marine Instruments Owner's Manual; 4 pages.

"Evinrude unveils $5,999 iDock joystick piloting system", Jul. 10, 2017; 4 pages.

Evinrude unveils $5,999 iDock joystick piloting system, Boating Industry, dated Jul. 10, 2017; 4 pages.

International Preliminary Report on Patentability received for PCT Patent Application No. PCT/US2020/052973, mailed on Apr. 7, 2022, 8 pages.

International Search Report and Written Opinion issued by the International Searching Authority, dated Dec. 21, 2020, for International Patent Application No. PCT/US2020/052973; 17 pages.

Office Action issued by the Canadian Intellectual Property Office, dated Aug. 10, 2021, for Canadian Patent Application No. 3,082,689; 6 pages.

* cited by examiner

SYSTEM AND METHOD FOR POSITIONING AN AQUATIC VESSEL

RELATED APPLICATIONS

This application is related to U.S. Patent Application No. 62/907,250, filed Sep. 27, 2019, titled SYSTEM AND METHOD FOR POSITIONING AN AQUATIC VESSEL and to U.S. Patent Application No. 63/012,992, filed Apr. 21, 2020, titled SYSTEM AND METHOD FOR WATERCRAFT POSITIONING, the entire disclosures of which are expressly incorporated by reference herein.

FIELD

The present disclosure relates to systems and methods to change position of an aquatic vessel and in particular an automatic system for changing a position of a pontoon boat including a thruster system to position the pontoon boat.

BACKGROUND

Pontoon and other types of multi-hull boats are known. It is known to include at least one outboard engine positioned at the stern of the boat to propel the boat through the water.

SUMMARY

In an exemplary embodiment of the present disclosure, In an exemplary embodiment of the present disclosure, a pontoon boat which is positionable relative to a mooring implement is provided. The pontoon boat comprising a plurality of pontoons; a deck supported by the plurality of pontoons, the deck having an outer perimeter; a thruster system including at least one water inlet in the plurality of pontoons and a plurality of water outlets in the plurality of pontoons; a plurality of sensors supported by the plurality of pontoons; and at least one controller operatively coupled to the plurality of sensors and the thruster system. The at least one controller configured to automatically position the pontoon boat relative to the mooring implement with the thruster system based on input from the plurality of sensors.

In an example thereof, the plurality of pontoons includes a port side pontoon, a starboard side pontoon, and a third pontoon positioned between the port side pontoon and the starboard side pontoon, each of the plurality of pontoons extending longitudinally under the deck. In a variation thereof, the at least one water inlet and the plurality of water outlets are provided in the third pontoon.

In another example thereof, the plurality of water outlets includes a port-bow outlet. In a variation thereof, the plurality of water outlets includes a port-stern outlet. In a further variation thereof, the plurality of water outlets includes a starboard-bow outlet. In a still further variation thereof, the plurality of water outlets includes a starboard-stern outlet.

In yet another example, the thruster system further includes at least one fluid pump which pumps fluid from the at least one inlet towards at least one of the plurality of outlets.

In still another example, the pontoon boat further comprises an outboard motor positioned at a stern of the pontoon board.

In a further example thereof, the mooring implement is a dock. In another example thereof, the mooring implement is a lift. In still another example thereof, the mooring implement is a slip.

In yet a further example thereof, the plurality of sensors includes a plurality of stereo cameras. In a variation thereof, a first stereo camera of the plurality of stereo cameras is oriented to enhance detection of horizontal features.

In still another example thereof, the plurality of sensors includes a LIDAR system.

In another exemplary embodiment of the present disclosure, a method of automatically docking a pontoon boat relative to a mooring implement is provided. The method comprising receiving sensor data regarding a target docking location proximate the mooring implement; activating a thruster system provided in at least one pontoon of the pontoon boat; automatically controlling a movement of the pontoon boat to the target docking location; and providing an indication when the pontoon boat is in the target docking location.

In an example thereof, the step of activating the thruster system follows the further steps of presenting a representation of the target docking location to an operator; and receiving confirmation from the operator of a selection of the target docking location. In a variation thereof, the step of presenting the representation of the target docking location to the operator includes the step of displaying the representation on a handheld operator device which communicates with the pontoon boat over a network.

In another example thereof, the method further comprises the step of maintaining a position of the pontoon boat in the target docking location with the thruster system.

In still another example thereof, the step of receiving sensor data regarding the target docking location proximate the mooring implement includes the step of receiving position information from a sensor associated with the mooring implement.

In yet another example thereof, the step of receiving sensor data regarding the target docking location proximate the mooring implement includes the step of receiving information regarding a fiducial associated with the mooring implement.

In a further exemplary embodiment of the present disclosure, a method of automatically docking an aquatic vessel having an outboard motor relative to a mooring implement is provided. The method comprising receiving sensor data regarding a target docking location proximate the mooring implement; activating a thruster system of the aquatic vessel to propel the aquatic vessel; determining the outboard motor of the aquatic vessel is in a raised position; in response to determining the outboard motor is in the raised position, automatically controlling a movement of the aquatic vessel to the target docking location; and providing an indication when the aquatic vessel is in the target docking location.

In an example thereof, the step of activating the thruster system follows the further steps of presenting a representation of the target docking location to an operator; and receiving confirmation from the operator of a selection of the target docking location. In a variation thereof, the step of presenting the representation of the target docking location to the operator includes the step of displaying the representation on a handheld operator device which communicates with the aquatic vessel over a network.

In another example, the method further comprising the step of maintaining a position of the aquatic vessel in the target docking location with the thruster system.

BRIEF DESCRIPTION OF THE DRAWINGS

The above-mentioned and other features and advantages of this disclosure, and the manner of attaining them, will become more apparent and will be better understood by reference to the following description of exemplary embodiments taken in conjunction with the accompanying drawings, wherein.

Corresponding reference characters indicate corresponding parts throughout the several views. The exemplification set out herein illustrates an exemplary embodiment of the invention and such exemplification is not to be construed as limiting the scope of the invention in any manner.

DETAILED DESCRIPTION OF THE DRAWINGS

Figure 1:
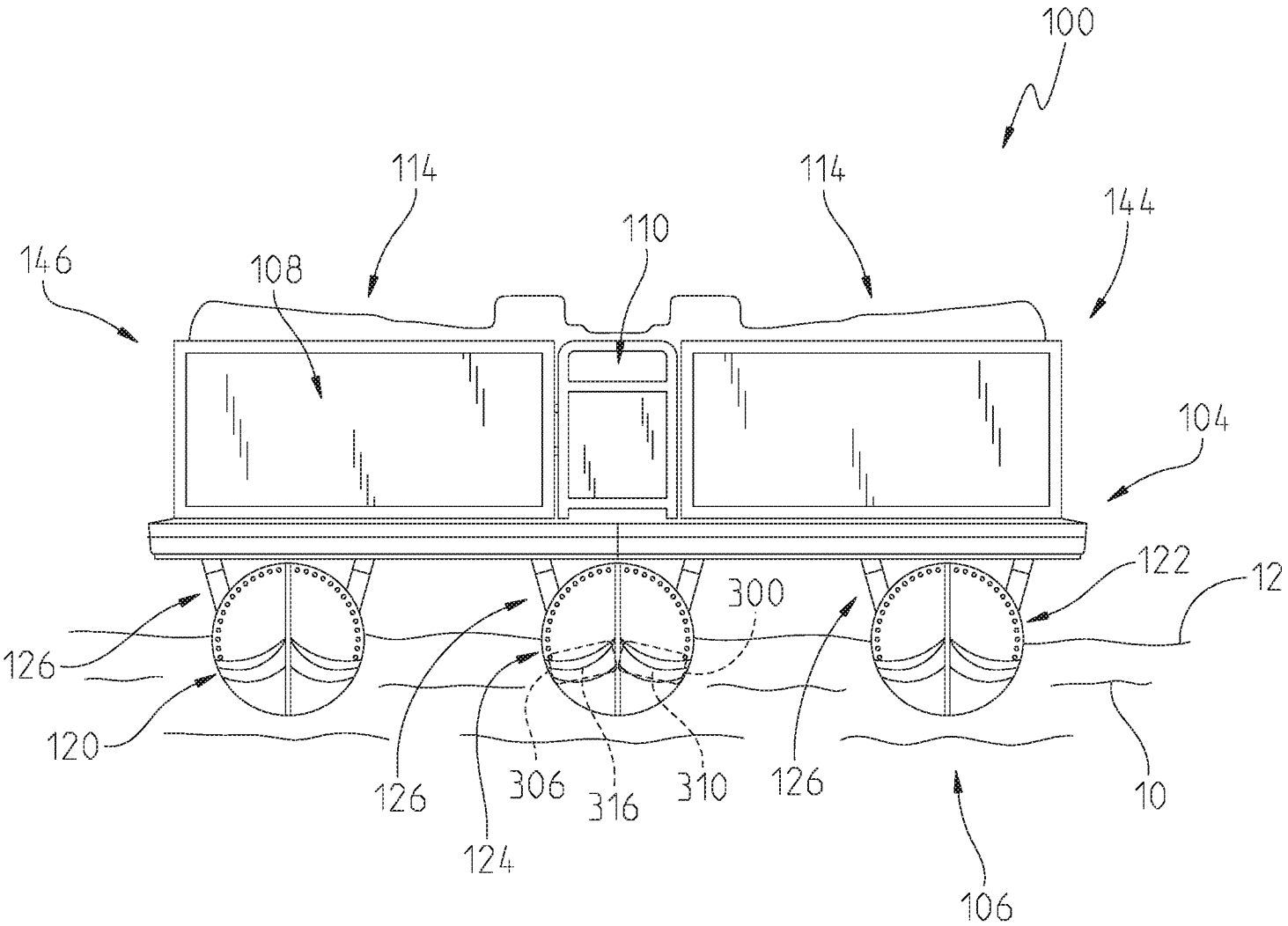
FIG. 1 illustrates a front view of a pontoon boat having a deck supported by a plurality of pontoons.

For the purposes of promoting an understanding of the principles of the present disclosure, reference is now made to the embodiments illustrated in the drawings, which are described below. The embodiments disclosed herein are not intended to be exhaustive or limit the present disclosure to the precise form disclosed in the following detailed description. Rather, the embodiments are chosen and described so that others skilled in the art may utilize their teachings. Therefore, no limitation of the scope of the present disclosure is thereby intended. Corresponding reference characters indicate corresponding parts throughout the several views.

The terms "couples", "coupled", "coupler" and variations thereof are used to include both arrangements wherein the two or more components are in direct physical contact and arrangements wherein the two or more components are not in direct contact with each other (e.g., the components are "coupled" via at least a third component), but yet still cooperate or interact with each other.

In some instances throughout this disclosure and in the claims, numeric terminology, such as first, second, third, and fourth, is used in reference to various components or features. Such use is not intended to denote an ordering of the components or features. Rather, numeric terminology is used to assist the reader in identifying the component or features being referenced and should not be narrowly interpreted as providing a specific order of components or features.

The embodiments disclosed herein may be used with any type of aquatic vessel, including pontoon boats, single hull boats, and other types of aquatic vessels. An exemplary aquatic vessel, a pontoon boat 100 is provided as an example.

Referring to FIG. 1, an exemplary pontoon boat 100 is floating in a body of water 10 having a top surface 12. Pontoon boat 100 includes a deck 104 supported by a plurality of pontoons 106. The deck supports a railing 108 including a gate 110 positioned in a bow portion 112 (see FIG. 2) of pontoon boat 100. Pontoon boat 100 may further include a plurality of seats 114, a canopy (see FIG. 10 for an example), and other components supported by deck 104.

Figure 2:
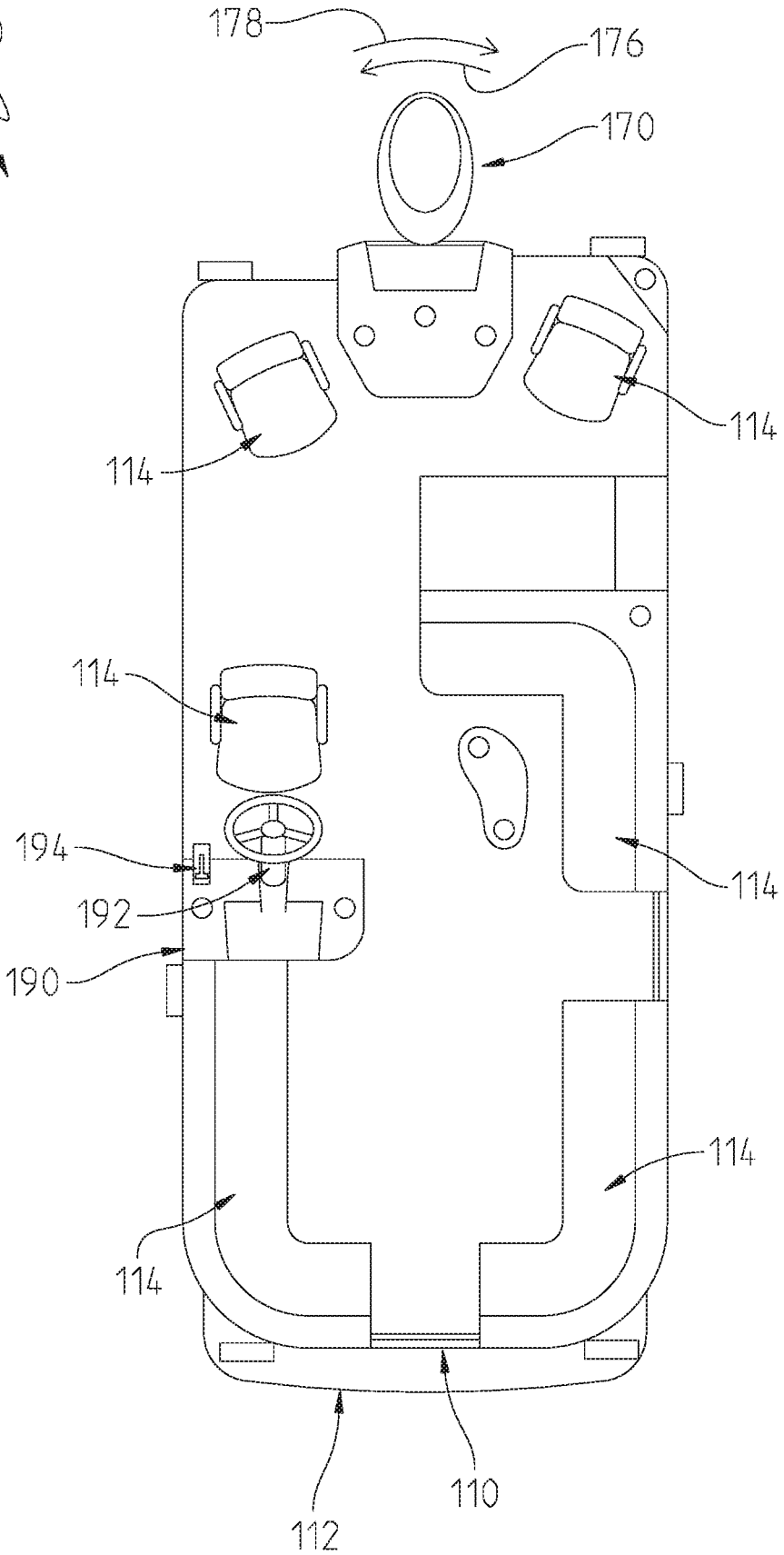
FIG. 2 illustrates a top view of a pontoon boat having a deck and seating.

Referring to FIG. 2, one contemplated arrangement of seating 114 on deck 104 is illustrated. Other arrangements are also contemplated. As shown in FIG. 2, pontoon boat 100 further includes an operator console 190 having a plurality of operator controls including a steering input, illustratively steering wheel 192, and a throttle control, illustratively a throttle lever 194, and other exemplary controls.

Returning to FIG. 1, the plurality of pontoons 106 include a starboard pontoon 120, a port pontoon 122, and a central pontoon 124. Each of starboard pontoon 120, port pontoon 122, and central pontoon 124 support deck 104 through respective brackets 126. Each of starboard pontoon 120, port pontoon 122, and central pontoon 124 support deck 104 above top surface 12 of water 10. Although three pontoons are illustrated, the plurality of pontoons 106 may be limited to two pontoons or have four or more pontoons. Further, the thruster systems described herein may be used with a single hull vessel.

Figure 3:
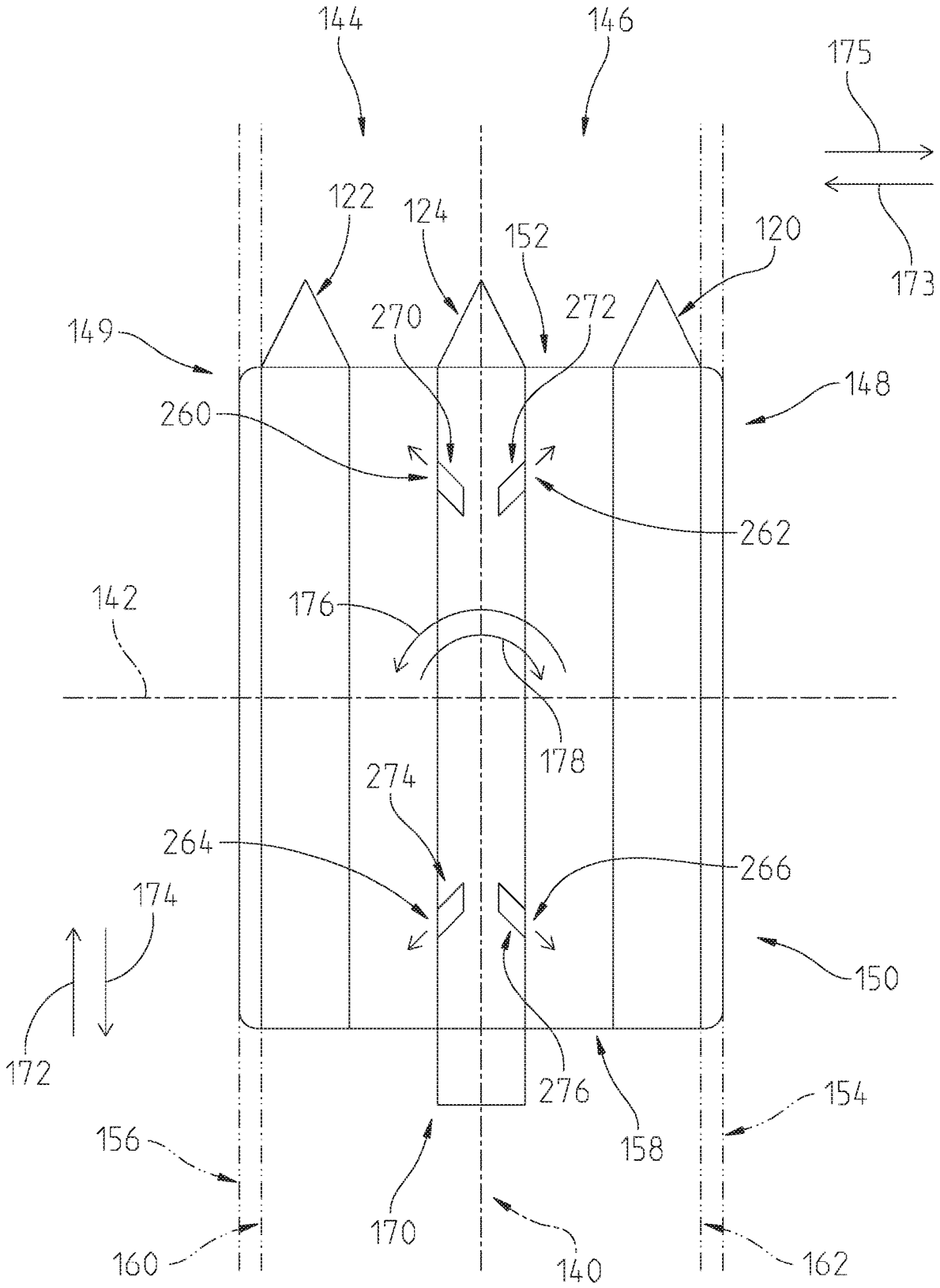
FIG. 3 illustrates a representative top view of the pontoon boat of FIG. 1 including a thruster system having a first group of thruster outlets positioned in a bow portion of the pontoon boat and directed towards the bow of the pontoon boat with a first one directed towards port and a second one directed towards starboard and a second group of thruster outlets positioned in a stern portion of the pontoon boat and directed towards the stern of the pontoon boat with a first one directed towards port and a second one directed towards starboard.

Referring to FIG. 3, pontoon boat 100 has a longitudinal centerline 140 and a lateral centerline 142. Longitudinal centerline 140 divides pontoon boat 100 into a port side 144 of pontoon boat 100 and a starboard side 146 of pontoon boat 100. Lateral centerline 142 divides pontoon boat 100 into a bow portion 148 of pontoon boat 100 and a stern portion 150 of pontoon boat 100. Deck 104 of pontoon boat 100 includes an outer perimeter 149 including a bow perimeter portion 152, a starboard perimeter portion 154, a stern perimeter portion 158, and a port perimeter portion 156. The plurality of pontoons 106 define a port extreme extent 160 corresponding to an outer extent of port pontoon 122 and a starboard extreme extent 162 corresponding to an outer extent of starboard pontoon 120.

Figure 14:
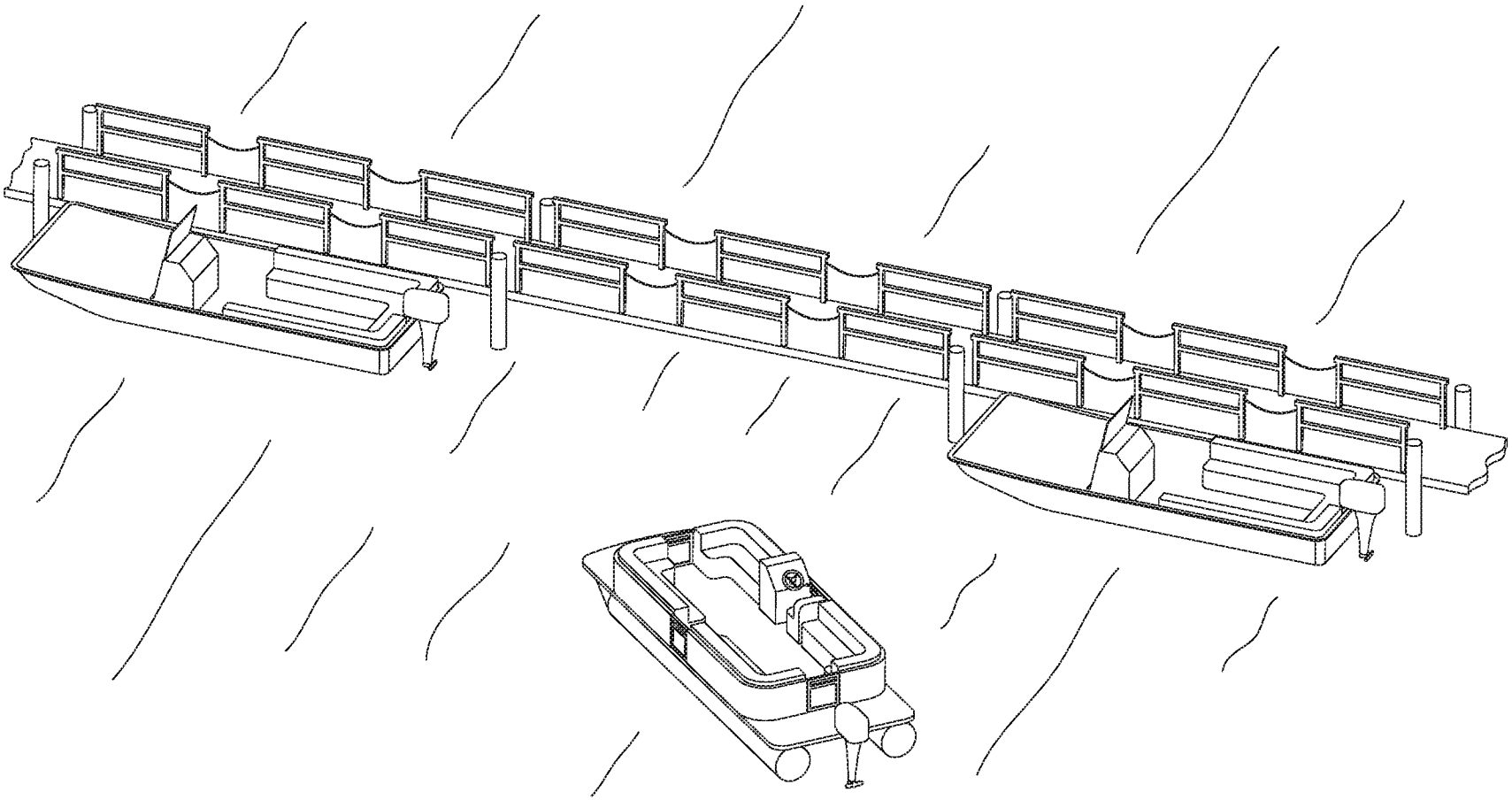
FIG. 14 illustrates a pontoon boat approaching an open docking position.

Pontoon boat 100 includes an outboard motor 170 which extends beyond stern perimeter portion 158 of deck 104. In embodiments, outboard motor 170 is an internal combustion engine which power rotation of a propeller (see FIG. 14). The propeller may be rotated in a first direction to propel pontoon boat 100 forward in a direction 172 or in a second direction to propel pontoon boat 100 rearward in a direction 174. In embodiments, outboard motor 170 is rotatably mounted relative to deck 104 such that an orientation of the propeller may be adjusted to turn pontoon boat 100 in one of direction 176 and direction 178. In embodiments, multiple outboard motors 170 may be provided. In one example, the multiple outboard motors 170 may be positioned adjacent the stern perimeter portion 158 of pontoon boat 100. Although the illustrated embodiment includes an outboard motor 170, motor 170 may also be an inboard motor positioned at least partially within perimeter 149 of pontoon boat 100.

Figure 5:
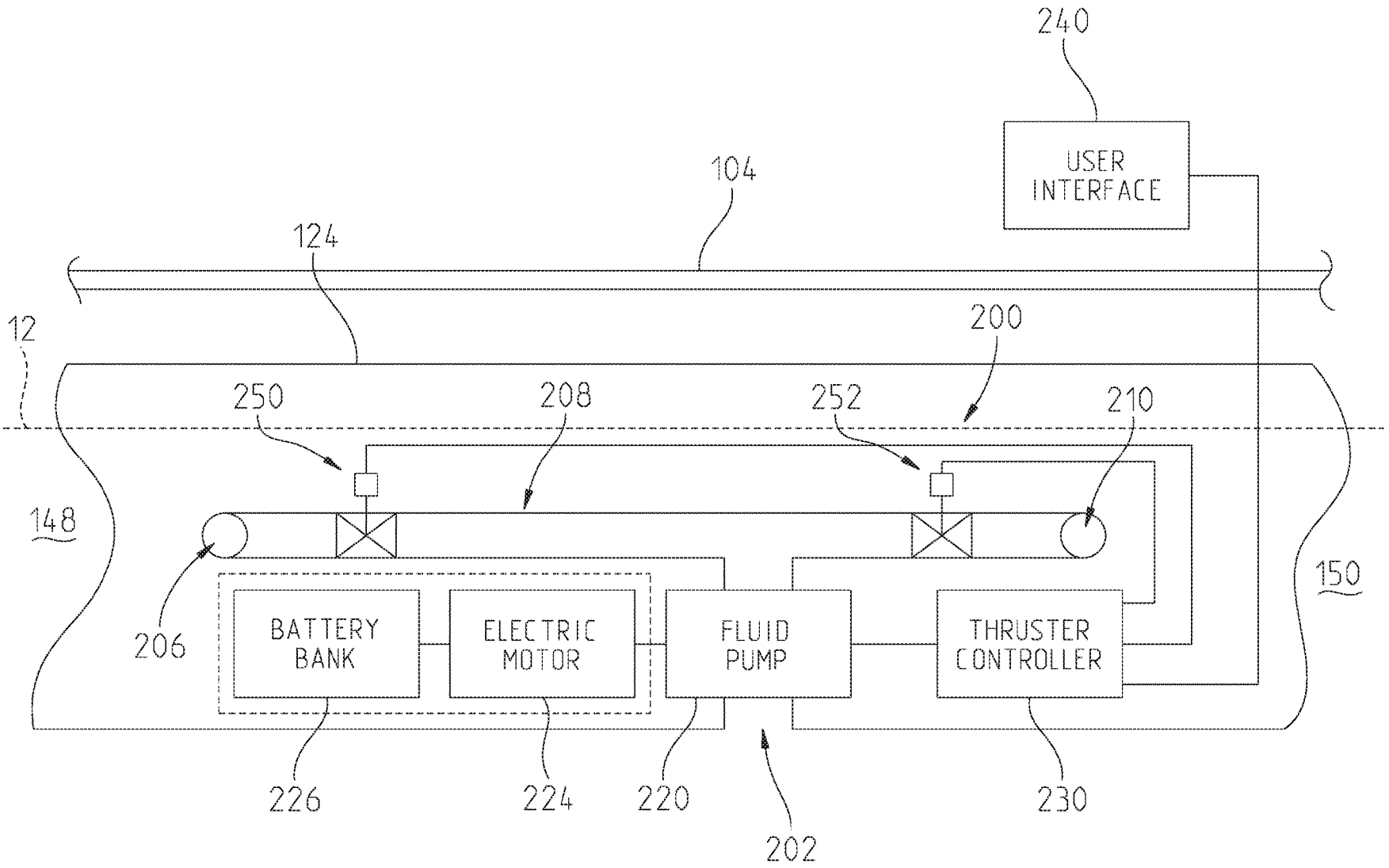
FIG. 5 illustrates a representative view of a portion of one of the plurality of pontoons of FIG. 1 including a thruster system.

Referring to FIG. 5, pontoon boat 100 further includes a thruster system 200. Thruster system 200 provides additional control over a position and/or orientation of pontoon boat 100. Thruster system 200 may carried by one or more of the plurality of pontoons 106. In embodiments, thruster system 200 is carried by central pontoon 124 or a combination of any one or more of starboard pontoon 120, port pontoon 122, and central pontoon 124. Thruster system 200 may be internal to one or more of the plurality of pontoons 106, external to the one or more plurality of pontoons, or a combination thereof. In embodiments, at least one of the plurality of pontoons 106, illustratively central pontoon 124, includes at least one water inlet, illustratively water inlet 202 of fluid conduit 204 is shown, and at least one water outlet, illustratively water outlet 206 and water outlet 210 both of fluid conduit 208, are shown. Fluid conduit 208 is fluidly coupled to fluid conduit 204. As shown in FIG. 5, each of water inlet 202, water outlet 206, and water outlet 210 are positioned below top surface 12 of water 10.

Thruster system 200 includes a fluid pump 220 positioned in fluid conduit 204 to move water from proximate water inlet 202 of fluid conduit 204 towards water outlet 206 and water outlet 210 of fluid conduit 208. Exemplary fluid pumps include the JT-30, JT-50, JT-70, and JT-90 series pumps available from Holland Marine Parts B.V. located at Donker Duyvisweg 297, 3316 BL Dordrecht (NL). Fluid pump 220 is powered by a power source 222. Illustratively power source 222 includes an electric motor 224 and a battery bank 226 which power electric motor 224. An exemplary battery bank 226 is a 24 volt lead acid battery.

The operation of fluid pump 220 is controlled with a controller 230. In embodiments, controller 230 is an electronic controller including processing circuits and memory. In embodiments, controller 230 is microprocessor-based and memory is a non-transitory computer readable medium which includes processing instructions stored therein that are executable by the microprocessor of controller to control operation of fluid pump 220. Exemplary non-transitory computer-readable mediums include random access memory (RAM), read-only memory (ROM), erasable programmable read-only memory (e.g., EPROM, EEPROM, or Flash memory), or any other tangible medium capable of storing information.

In embodiments, controller 230 is one of wired or wirelessly coupled to a user interface 240, such as operator console 190 (see FIG. 2), positioned above deck 104. User interface 240 includes one or more input devices. Exemplary input devices include switches, dials, joysticks, touch screens, cameras (to capture visual cues), microphones (to capture audio cues), and other suitable input devices for receiving a user input. In embodiments, the user interface is provided on a personal mobile device, such as a smart phone or tablet (see for example remote operator device 300 in FIG. 4), and the personal mobile device includes processing instructions which provide input to controller 230 over a wireless connection.

As shown in FIG. 5, in embodiments, controller 230 is also operatively coupled to a first valve 250 and a second valve 252. Controller 230 controls whether fluid from fluid pump 220 reaches water outlet 206 based on whether first valve 250 is open or closed by controller 230. Controller 230 controls whether fluid from fluid pump 220 reaches water outlet 210 based on whether second valve 252 is open or closed by controller 230. In embodiments, controller 230 may control additional valves to control fluid flow to additional water outlets.

For example, in the embodiment of FIG. 3, controller 230 controls a respective valve associated with each of the respective water outlets 260, 262, 264, and 266. The respective valves may be sequenced in a manner that permits the thruster system 200 to independently control the flow to each of water outlets 260, 262, 264, and 266. Controller 230 includes processing sequences which control the opening and closing of each of the respective valves to ensure that the valves are not closed in a manner that results in the water pressure in the thruster system spiking to exceed a threshold. In embodiments, controller 230 monitors a temperature of at least one of water in the thruster system and the fluid pump along with the states of the respective valves to minimize the chance of overheating of the thruster system and/or unwanted water pressure spikes.

In embodiments, thruster system 200 does not include valves 250 and 252. Rather, in one embodiment, fluid pump 220 is fluidly coupled to only water inlet 202 and water outlet 206 and a separate fluid pump 220 is provided to fluidly couple water inlet 202 and water outlet 210.

Figure 5A:
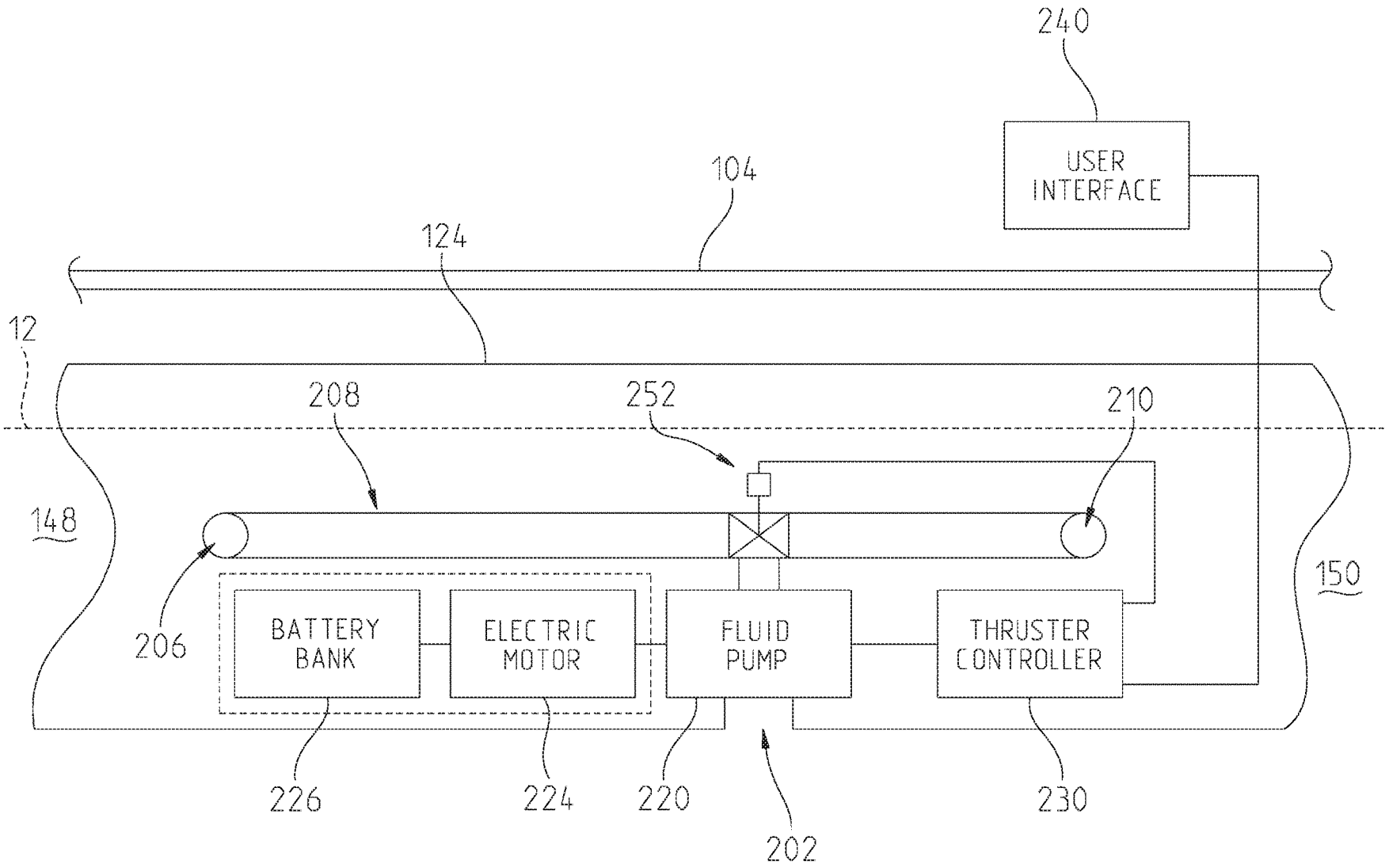
FIG. 5A illustrates a representative view of a portion of one of the plurality of pontoons of FIG. 1 including another exemplary thruster system.

In embodiments, thruster system includes a single valve 280 (see FIG. 5A). Valve 580 is a three-way valve and is positionable in an off configuration wherein water is not communicated to either of outlets 206 and 210, a first on configuration wherein water is communicated to only outlet 206, and a second on configuration wherein water is communicated to only outlet 210. In one example, outlet 206 is a starboard facing outlet and outlet 210 is a port facing outlet. In another example, outlet 206 is a starboard and stern facing outlet and outlet 210 is a port and stern facing outlet. In this example, a boat including thruster system 200 could be moved forward by pulsing between the first on configuration and the second on configuration. In another example, outlet 206 is a starboard and bow facing outlet and outlet 210 is a port and bow facing outlet. In this example, a boat including thruster system 200 could be moved backward by pulsing between the first on configuration and the second on configuration.

Returning to FIG. 3, an embodiment of thruster system 200 is illustrated. In FIG. 3, thruster system 200 includes four water outlets, a bow-port outlet 260, a bow-starboard outlet 262, a stern-port outlet 264, and a stern-starboard outlet 266. Bow-port outlet 260 has a corresponding fluid conduit 270 which causes water to exit bow-port outlet 260 in a direction, indicated by the arrow, towards both port side 144 of pontoon boat 100 and bow portion 148 of pontoon boat 100. Bow-starboard outlet 262 has a corresponding fluid conduit 272 which causes water to exit bow-starboard outlet 262 in a direction, indicated by the arrow, towards both starboard side 146 of pontoon boat 100 and bow portion 148 of pontoon boat 100. Stern-port outlet 264 has a corresponding fluid conduit 274 which causes water to exit stern-port outlet 264 in a direction, indicated by the arrow, towards both port side 144 of pontoon boat 100 and stern portion 150 of pontoon boat 100. Stern-starboard outlet 266 has a corresponding fluid conduit 276 which causes water to exit stern-starboard outlet 266 in a direction, indicated by the arrow, towards both starboard side 146 of pontoon boat 100 and stern portion 150 of pontoon boat 100. In embodiments, the direction of outlet 260 is straight towards port side 144 to cause water to exit in a direction towards port side 144 of pontoon boat 100 or angled to cause water to exit in a direction towards both port side 144 of pontoon boat 100 and stern portion 150 of pontoon boat 100, the direction of outlet 262 is straight towards starboard side 146 to cause water to exit in a direction towards starboard side 146 of pontoon boat 100 or angled to cause water to exit in a direction towards both starboard side 146 of pontoon boat 100 and stern portion 150 of pontoon boat 100, the direction of outlet 264 is straight towards port side 144 to cause water to exit in a direction towards port side 144 of pontoon boat 100 or angled to cause water to exit in a direction towards both port side 144 of pontoon boat 100 and bow portion 148 of pontoon boat 100, and/or the direction of outlet 266 is straight towards starboard side 146 to cause water to exit in a direction towards starboard side 146 of pontoon boat 100 or angled to cause water to exit in a direction towards both starboard side 146 of pontoon boat 100 and bow portion 148 of pontoon boat 100.

In embodiments, each of fluid conduits 270-276 are angled downward (see FIG. 1) so that water exiting the respective outlets 260-266 is directed downward, as opposed to straight horizontally. An advantage, among others, of angling the outlets 260-266 of fluid conduits 270-276 downward is increased stability of pontoon boat 100 in water 10. In embodiments, the outlets 260-266 of fluid conduits 270-276 of the depicted thrusters, and/or the outlets of fluid conduits of additional thrusters may be oriented horizontally, angled upward, angled downward or combinations thereof. In embodiments, the outlet direction of fluid conduits 270-276 and/or of additional fluid conduits is adjustable in at least one of vertically (e.g. upward, straight horizontally, and downward) and fore-aft (e.g. more towards bow portion 148, straight laterally towards one of port portion 144 and starboard portion 146, and more towards stern portion 150).

In embodiments, each of fluid conduit 270, fluid conduit 272, fluid conduit 274, and fluid conduit 276 are fed by a respective fluid pump 220 from one or more water inlets 202 in central pontoon 124. The respective fluid pumps 220 may be independently or jointly controlled by controller 230. In embodiments, a plurality of fluid conduit 270, fluid conduit 272, fluid conduit 274, and fluid conduit 276 are fed by a common fluid pump 220 and one or more valves are included to control which of the plurality of fluid conduit 270, fluid conduit 272, fluid conduit 274, and fluid conduit 276 are in fluid communication with the common fluid pump 220.

Additional details regarding exemplary thruster systems and operator inputs are provided in U.S. Provisional Patent Application Ser. No. 62/859,507, filed Jun. 10, 2019, titled THRUSTER ARRANGEMENT FOR A BOAT, ("Thruster Provisional Application"), the entire disclosure of which is expressly incorporated by reference herein. Further, in embodiments, thruster system 200 may include any combination of water jet thruster fluid pumps 220, propellers, or other suitable thrust system.

Figure 4:
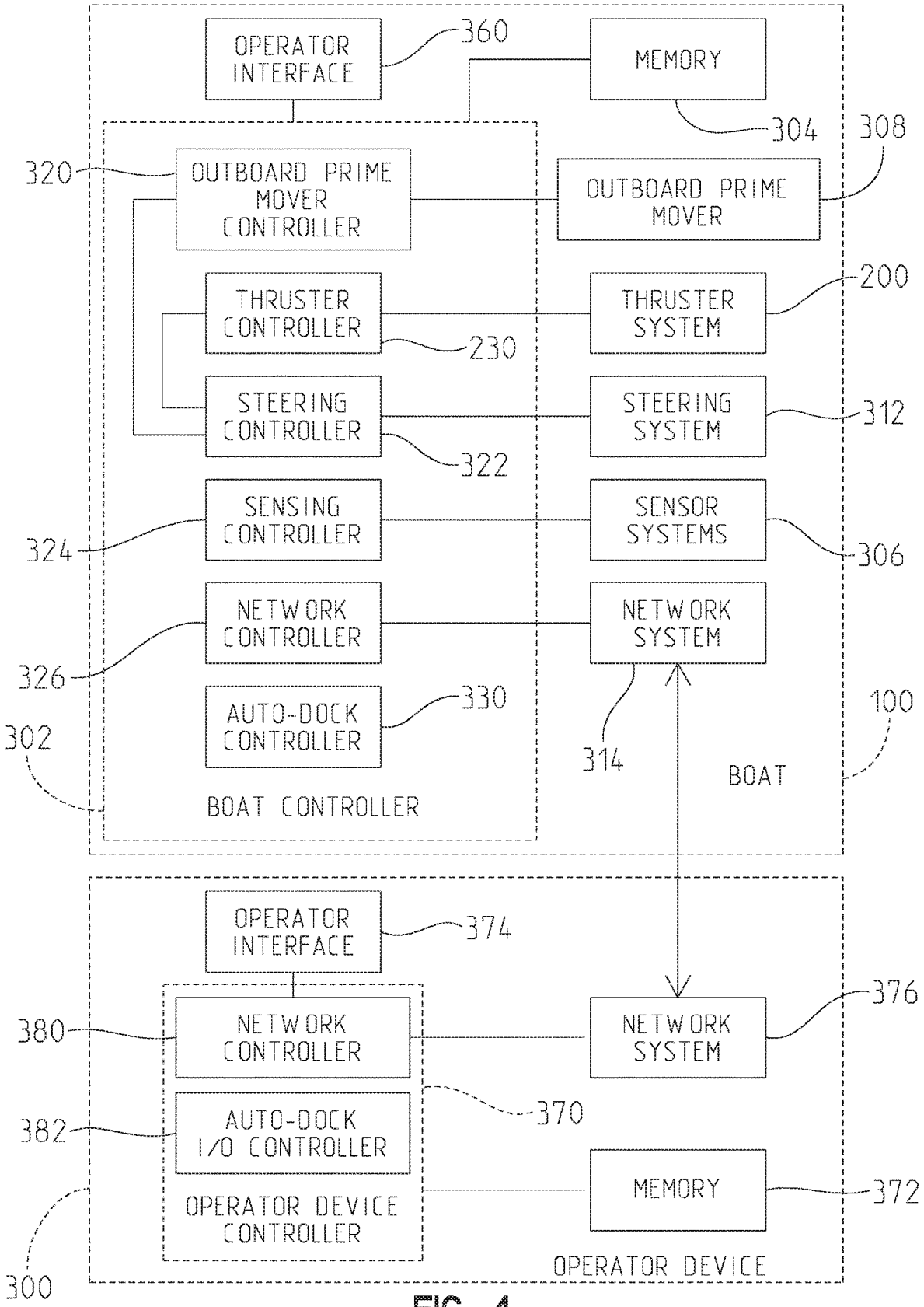
FIG. 4 illustrates a representative view of the systems of the pontoon boat of FIG. 1 and an auto-positioning control device.

Referring to FIG. 4, systems of pontoon boat 100 and a remote operator device 300 are illustrated. Pontoon boat 100 includes a boat controller 302 having at least one associated memory 304. Memory 304 is one or more non-transitory computer readable mediums. Memory 304 may be representative of multiple memories which are provided locally with boat controller 302 or otherwise available to boat controller 302 over a network. The information recorded or determined by boat controller 302 may be stored on memory 304. In embodiments, memory 304 is distributed.

Boat controller 302 provides the electronic control of the various components of pontoon boat 100. Further, boat controller 302 is operatively coupled to a plurality of sensors 306 which monitor various parameters of pontoon boat 100 or the environment surrounding pontoon boat 100. Exemplary sensed parameters include, but are not limited to, location (e.g. GPS location), relative location to surrounding environmental objects, water current, wind speed, angular orientation of boat 100 (e.g. pitch, roll, yaw), wave height, water temperature, water depth, water clarity, presence of environmental objects (e.g. other aquatic vessels, docks, buoys, fallen trees, sandbars). One or more sensors 306 may be integrated into the hull structure of boat 100. Boat controller 302 performs certain operations to control one or more subsystems of other boat components, such as one or more of sensor systems 306, an outboard prime mover system 308, thruster system 200, a steering system 312, a network system 314, and other systems. Boat controller 302 illustratively includes an outboard prime mover controller 320 which operates outboard prime mover system 308, thruster controller 230 which operates thruster system 200, a steering controller 322 which operates steering system 312, a network controller 326 which operates network system 314, and an auto-dock controller 330 which as explained in more detail herein operates the systems of pontoon boat 100 to position pontoon boat 100 relative to a mooring implement, such as a dock, a slip, and a lift. In certain embodiments, boat controller 302 forms a portion of a processing subsystem including one or more computing devices having memory, processing, and communication hardware. Boat controller 302 may be a single device or a distributed device, and the functions of boat controller 302 may be performed by hardware and/or as computer instructions on a non-transient computer readable storage medium, such as memory 304.

In the illustrated embodiment of FIG. 4, boat controller 302 is represented as including several controllers, illustratively outboard prime mover controller 320, thruster controller 230, steering controller 322, sensing controller 324, network controller 326, and auto-dock controller 330. These controllers may each be single devices or distributed devices or one or more of these controllers may together be part of a single device or distributed device. The functions of these controllers may be performed by hardware and/or as computer instructions on a non-transient computer readable storage medium, such as memory 304. Although outboard prime mover controller 320, thruster controller 230, steering controller 322, sensing controller 324, network controller 326, and auto-dock controller 330 are illustrated as discrete controllers, in embodiments, one or more of outboard prime mover controller 320, thruster controller 230, steering controller 322, sensing controller 324, network controller 326, and auto-dock controller 330 may be part of the same controller.

In embodiments, boat controller 302 includes at least two separate controllers which communicate over a network. In one embodiment, the network is a CAN network. In one embodiment, the CAN network is implemented in accord with the J1939 protocol. Details regarding an exemplary CAN network are disclosed in U.S. patent application Ser. No. 11/218,163, filed Sep. 1, 2005, the disclosure of which is expressly incorporated by reference herein. Of course, any suitable type of network or data bus may be used in place of the CAN network. In one embodiment, two wire serial communication is used.

Outboard prime mover system 308 includes a prime mover, illustratively outboard motor 170 in FIG. 2. Exemplary prime movers include outboard style motors, inboard style motors, internal combustion engines, two stroke internal combustion engines, four stroke internal combustion engines, diesel engines, electric motors, hybrid engines, jet powered engines, and other suitable sources of motive force. Outboard prime mover system 308 further includes a power supply system (not shown). The type of power supply system depends on the type of prime mover used. In embodiments, the prime mover is an internal combustion engine and the power supply system is one of a pull start system and an electric start system. Outboard prime mover system 308, in the case of an internal combustion engine, would further include a fuel system and air intake system which provide fuel and air to the internal combustion engine. In embodiments, the prime mover is an electric motor and power supply system is a switch system which electrically couples one or more batteries to the electric motor. In embodiments, the prime mover is a jet-based engine which requires an auxiliary pump and/or water intake system.

Thruster system 200, as discussed herein and as disclosed in Thruster Provisional Application which is incorporated by reference herein, includes one or more thruster fluid pumps, valves, and other components.

Steering system 312 includes one or more devices which are controlled to alter a direction of travel of pontoon boat 100. In embodiments, steering system 312 includes a hydraulic system (not shown) which orients outboard motor 170 relative to deck 104. By turning outboard motor 170 relative to deck 104 a direction of travel of pontoon boat 100 may be altered. In embodiments, outboard motor 170 is stationary and pontoon boat 100 includes a separate rudder which is oriented by steering system 312 relative to deck 104 to steer pontoon boat 100. In embodiments, steering system 312 provides input to thruster system 200 to control operation of thruster system 200 to move and orient pontoon boat 100.

Sensor system 306 includes one or more sensing systems which provide input to boat controller 302 for operation of boat controller 302 and other sub-systems. Exemplary sensor systems for guiding the position of pontoon boat 100 include camera systems, stereo camera systems, location determiners such as GPS systems, accelerometers, magnetometers, gyroscopes, LIDAR systems, radar systems, ultrasound systems, piezo tubes, echo sounder, sonic pulse, acoustic Doppler, sonar, Inertial Measurement Units (IMUs), millimeter wave systems, and other suitable sensor systems to identify environmental objects such as docks, boats, buoys, and other objects. As discussed herein, in embodiments, sensor systems 306 may determine the location of objects surrounding pontoon boat 100 and, in embodiments, sensor systems 306 may utilize one or more fiducials affixed to an object, such as a mooring implement, to determine a location of pontoon boat 100 relative to the mooring implement.

Controller 302 further includes a network controller 326 which controls communication between pontoon boat 100 and remote devices through one or more network systems 314. In embodiments, network controller 326 of pontoon boat 100 communicates with remote devices over a wireless network. An exemplary wireless network is a radio frequency network utilizing a BLUETOOTH protocol or other wireless protocol. In this example, network system 314 includes a radio frequency antenna. Network controller 326 controls the communications between pontoon boat 100 and the remote devices. An exemplary remote device is remote operator device 300 described herein.

Boat controller 302 also interacts with an operator interface 362 which includes at least one input device and at least one output device. Exemplary input devices include levers, buttons, switches, soft keys, joysticks, and other suitable input devices. Exemplary output devices include lights, displays, audio devices, tactile devices, and other suitable output devices. In embodiments, the output devices include a display and boat controller 302 formats information to be displayed on the display and operator interface 360 displays the information. In one embodiment, input devices and output devices include a touch display and boat controller 302 formats information to be displayed on the touch display, operator interface 360 displays the information, and operator interface 360 monitors the touch display for operator input. Exemplary operator inputs include a touch, a drag, a swipe, a pinch, a spread, and other known types of gesturing. In embodiments, the output devices provide feedback on the position of pontoon boat 100 relative to a dock, a lift, a slip, or a goal location via one or more of audio, visual, and tactile queues.

Boat controller 302 may further receive input from or send output to remote operator device 300. Remote operator device 300 includes an operator device controller 370 with associated memory 372, an operator interface 374, and a network system 376. Exemplary remote operator device 300 include cellular phones, tablets, and other remote interfaces which may be handheld or mounted to pontoon boat 100. Exemplary cellular phones, include the IPHONE brand cellular phone sold by Apple Inc., located at 1 Infinite Loop, Cupertino, CA 95014 and the GALAXY brand cellular phone sold by Samsung Electronics Co., Ltd. Exemplary tablets in the IPAD brand tablet sold by Apple Inc.

Operator device controller 370 includes a network controller 380 which controls communications between remote operator device 300 and other devices, such as pontoon boat 100, through one or more network systems 314. In embodiments, network controller 380 of remote operator device 300 communicates with remote devices over a wireless network. An exemplary wireless network is a radio frequency network utilizing a BLUETOOTH protocol or other wireless protocol. In this example, network system 376 includes a radio frequency antenna. In embodiments, remote operator device 300 may be connected with pontoon boat 100 through a wired network.

Operator interface 374 includes at least one input device and at least one output device. Exemplary input devices include levers, buttons, switches, soft keys, and other suitable input devices. Exemplary output devices include lights, displays, audio devices, tactile devices, and other suitable output devices. In embodiments, the output devices include a display and operator device controller 370 formats information to be displayed on the display and operator interface 374 displays the information. In one embodiment, input devices and output devices include a touch display and operator device controller 370 formats information to be displayed on the touch display, operator interface 374 displays the information, and operator interface 374 monitors the touch display for operator input. Exemplary operator inputs include a touch, a drag, a swipe, a pinch, a spread, and other known types of gesturing.

Operator device controller 370 includes an auto-dock I/O controller 382. Auto-dock I/O controller 382 interacts with auto-dock controller 330 of pontoon boat 100 to, as explained in more detail herein, operate the systems of pontoon boat 100 to position pontoon boat 100 relative to a mooring implement, such as a dock, a boat slip, a lift, or other suitable mooring implement. Further, the systems of pontoon boat 100 may be used to position boat 100 relative to a sandbar/beach or buoy. In the illustrated embodiment of FIG. 4, operator device controller 370 is represented as including several controllers, illustratively network controller 380 and auto-dock I/O controller 382. These controllers may each be single devices or distributed devices or one or more of these controllers may together be part of a single device or distributed device. The functions of these controllers may be performed by hardware and/or as computer instructions on a non-transient computer readable storage medium, such as memory 372 and/or memory 304. Although network controller 380 and auto-dock I/O controller 382 are illustrated as discrete controllers, in embodiments, network controller 380 and auto-dock I/O controller 382 may be part of the same controller.

Auto-dock I/O controller 382 is illustrated as part of operator device controller 370. In embodiments, pontoon boat 100 includes a display as part of operator interface 360 and the functionality of auto-dock I/O controller 382 is provided as part of boat controller 302.

Figure 6:
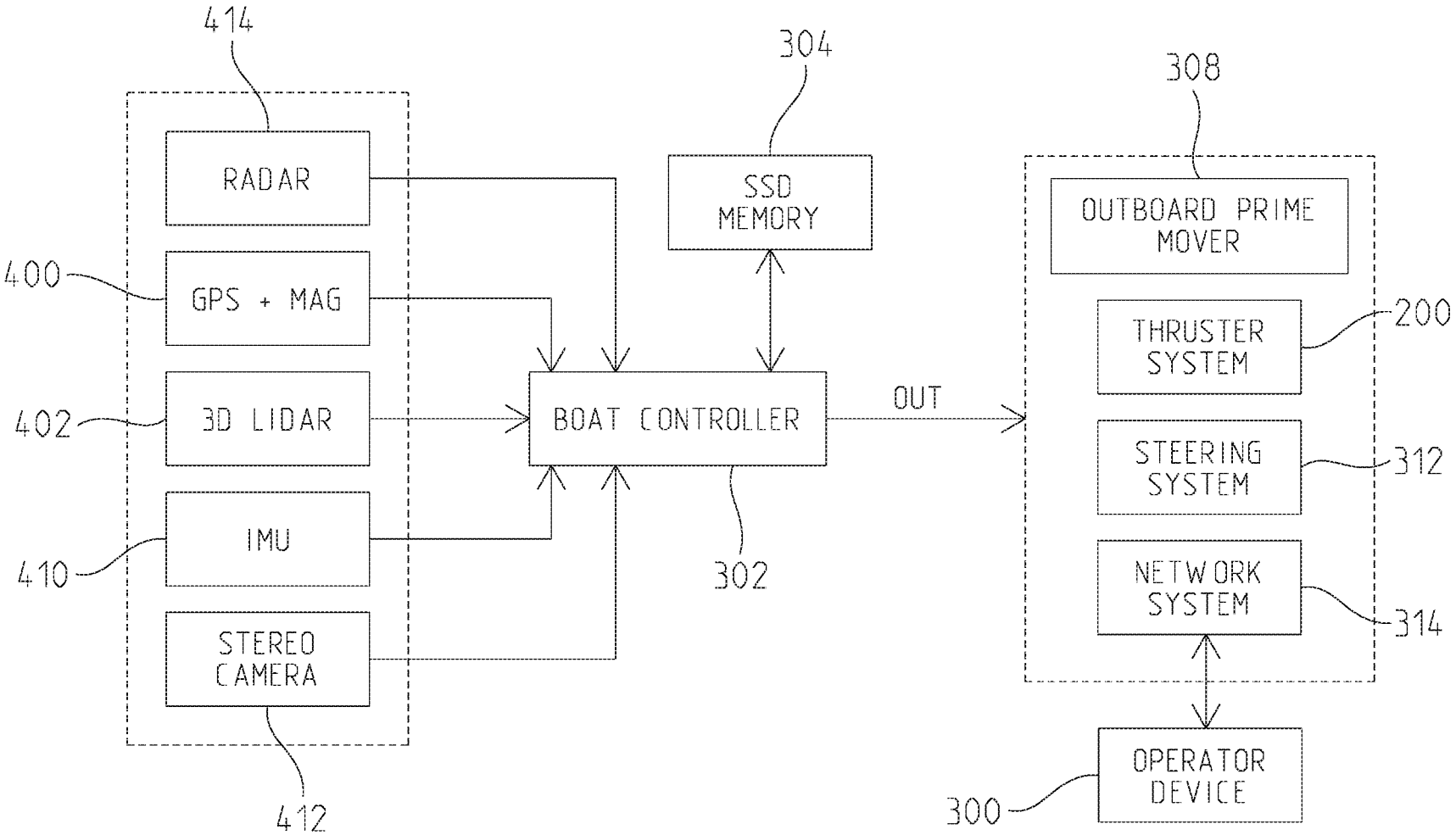
FIG. 6 illustrates a representative view of exemplary sensor systems.

Referring to FIG. 6, exemplary sensors of sensors 306 are represented. Sensors 306 may include a GPS/Magnetometer 400. The GPS (Global Positioning System) of GPS/magnetometer 400 determines a location of pontoon boat 100 on the Earth. The magnetometer of GPS/magnetometer 400 determines an orientation of pontoon boat 100 relative to the magnetic field of the Earth. Although illustrated as a single device separate GPS and magnetometer devices may be used. Further, other suitable devices for determining a location of pontoon boat 100 and an orientation of pontoon boat 100 may be used.

Figure 7:
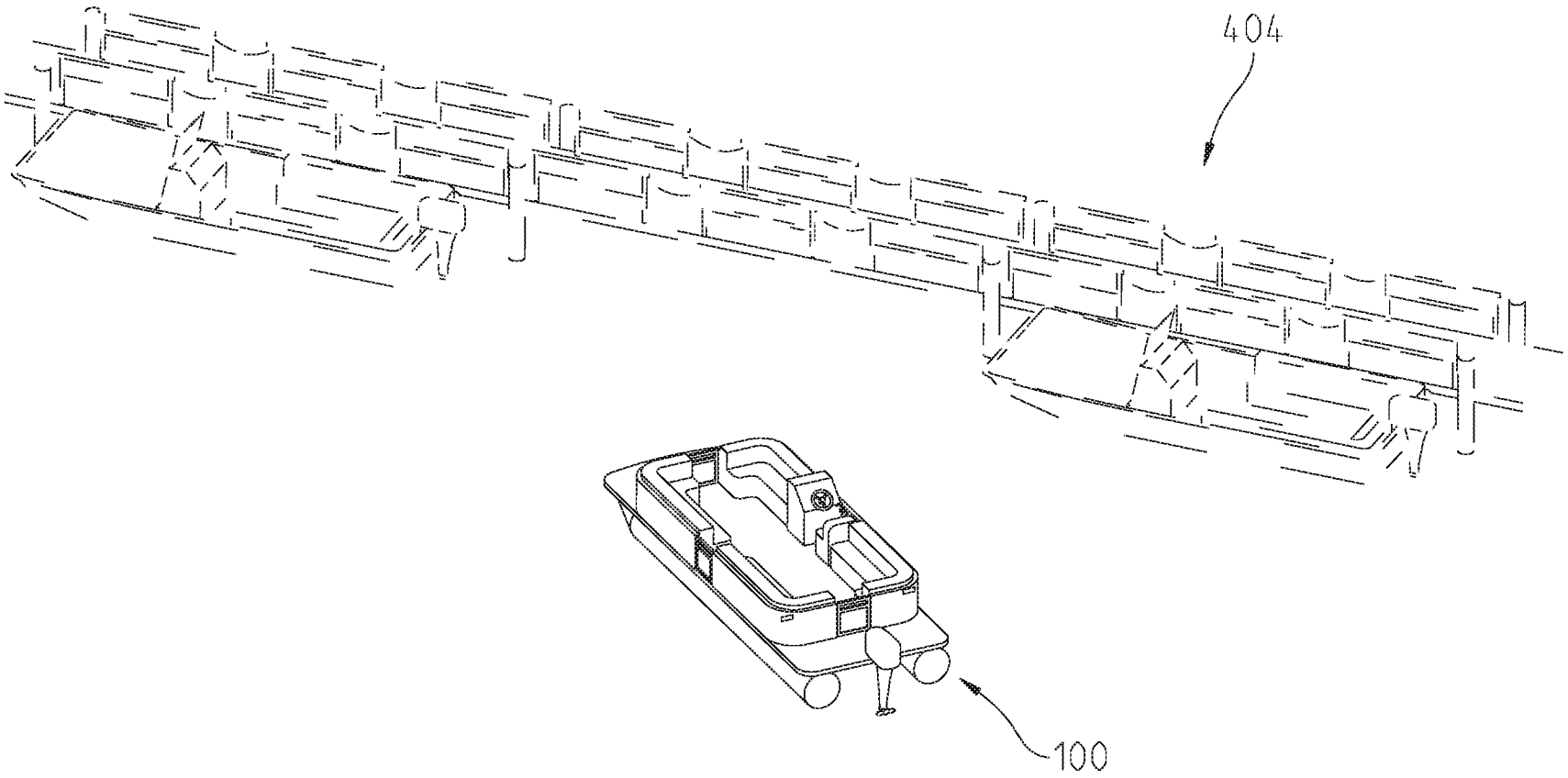
FIG. 7 illustrates an image of a LIDAR system output of an exemplary LIDAR system.

Sensors 306 may include a LIDAR (Light Detection and Ranging) system 402. LIDAR system 402 uses pulsed lasers to determine distance to surrounding objects. LIDAR system 402 provides three-dimensional geometry of the surroundings of pontoon boat 100 in the range of 20-100 meters from the LIDAR system 402. An advantage, among others, of LIDAR system 402 is that it is able to function day and night with a low dependence on lighting conditions. The data from LIDAR system 402 may be used to provide a reflectivity map, an example of which is shown as map 404 in FIG. 7. A representation of the location and orientation of pontoon boat 100 is also displayed on operator interface 374. The location and orientation of pontoon boat 100 relative to surrounding objects may be determined by boat controller 302 based the output of LIDAR system 402.

Sensors 306 may include a radar system 414. Radar system 414 provides distance to surrounding objects. The location and orientation of pontoon boat 100 relative to surrounding objects may be determined by boat controller 302 based the output of radar system 414.

Sensors 306 may include an IMU (Inertial Measurement Unit) system 410. IMU 410 provides an angular position of pontoon boat 100 including one or more of a pitch angle, a roll angle, and a yaw angle and accelerations of pontoon boat 100 in each of the x, y, and z axes. This output may be used to determine an orientation of pontoon boat 100 and to determine whether auto-dock controller 330 of boat controller 302 may be activated. For example, auto-dock controller 330 may include a threshold that a pitch and/or roll of pontoon boat 100 must be less than, such as 10 degrees, 5 degrees, or 3 degrees, for auto-dock controller 330 to continue. In embodiments, sensors 306 may further include a wind sensor (not shown) and auto-dock controller 330 may include a threshold that wind speed must be less than, such as 20 miles per hour, for auto-dock controller 330 to continue.

Sensors 306 may include one or more stereo cameras 412. Stereo cameras 412 provide a three-dimensional geometry of the surroundings of pontoon boat 100 in the range of 10-15 meters from the stereo cameras 412. An advantage, among others, of stereo cameras 412 is that they are able to provide visible light video to operator interface 374 of remote operator device 300 for display. In embodiments, stereo cameras 412 provide grayscale information. In embodiments, stereo cameras 412 provide color information which may be used to classify objects or other operations.

Figure 8:
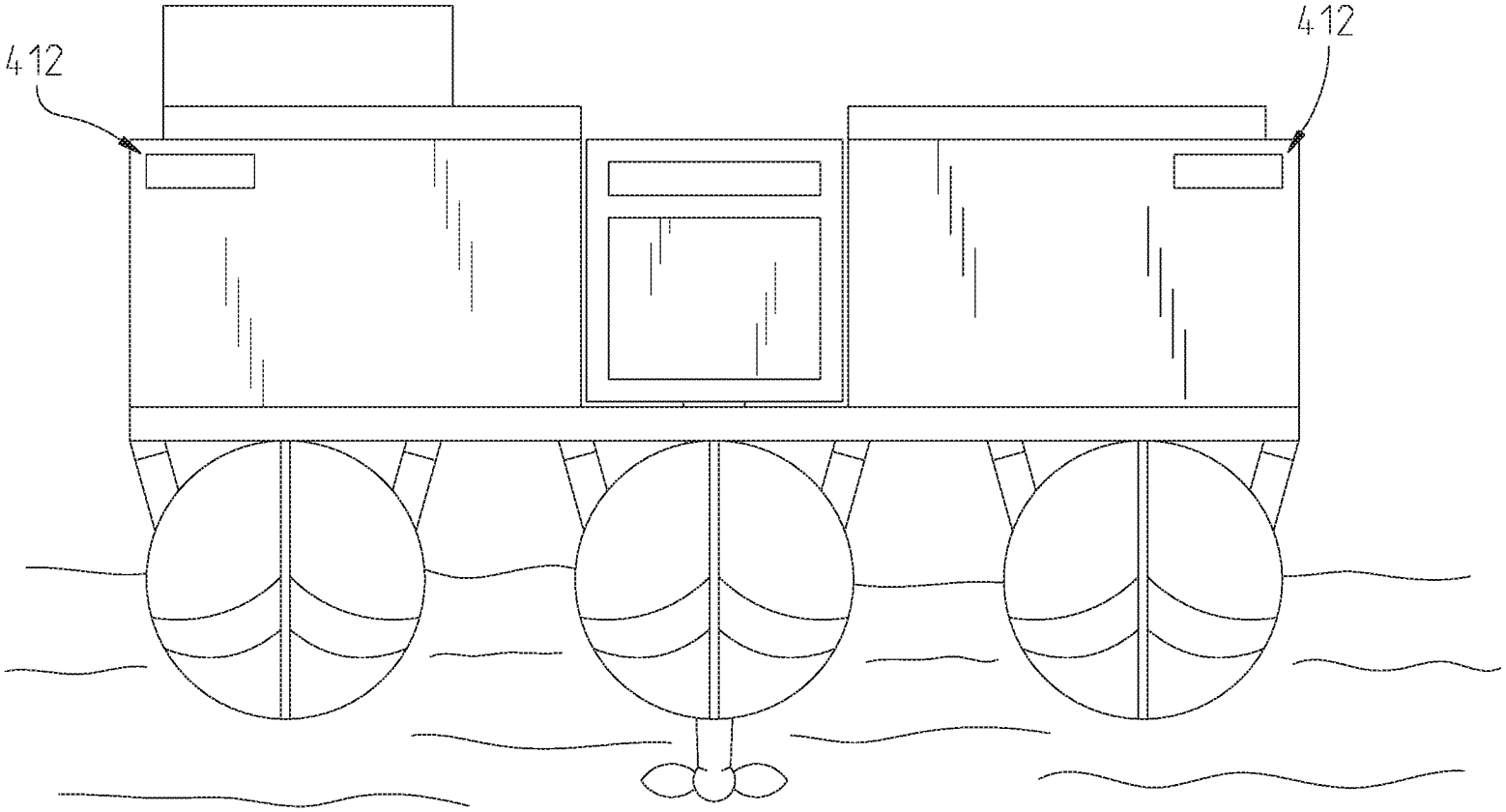
FIG. 8 illustrates exemplary positioning of bow stereo camera systems on an exemplary pontoon boat.
Figure 9:
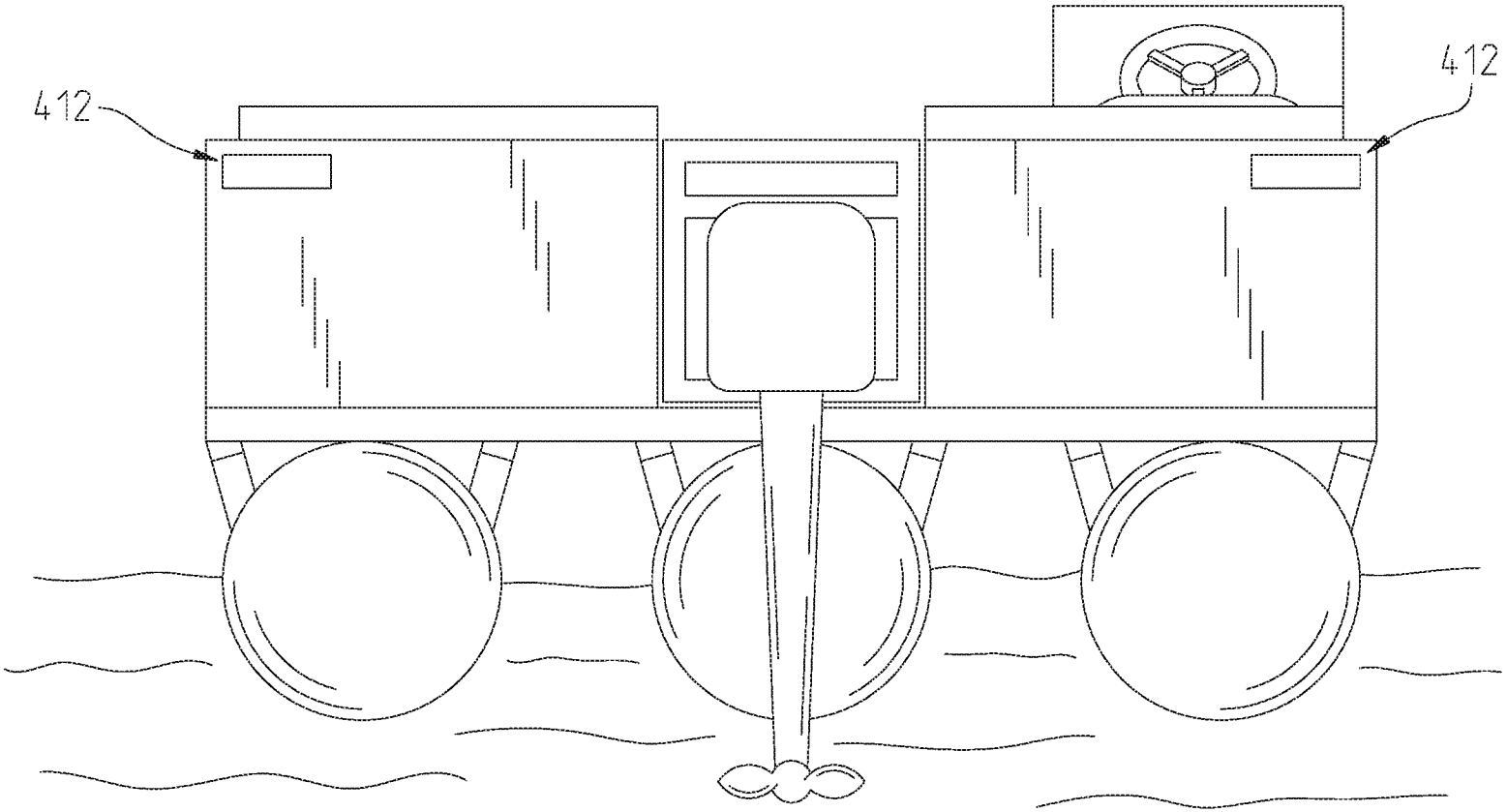
FIG. 9 illustrates exemplary positioning of stern stereo camera systems on an exemplary pontoon boat.
Figure 10:
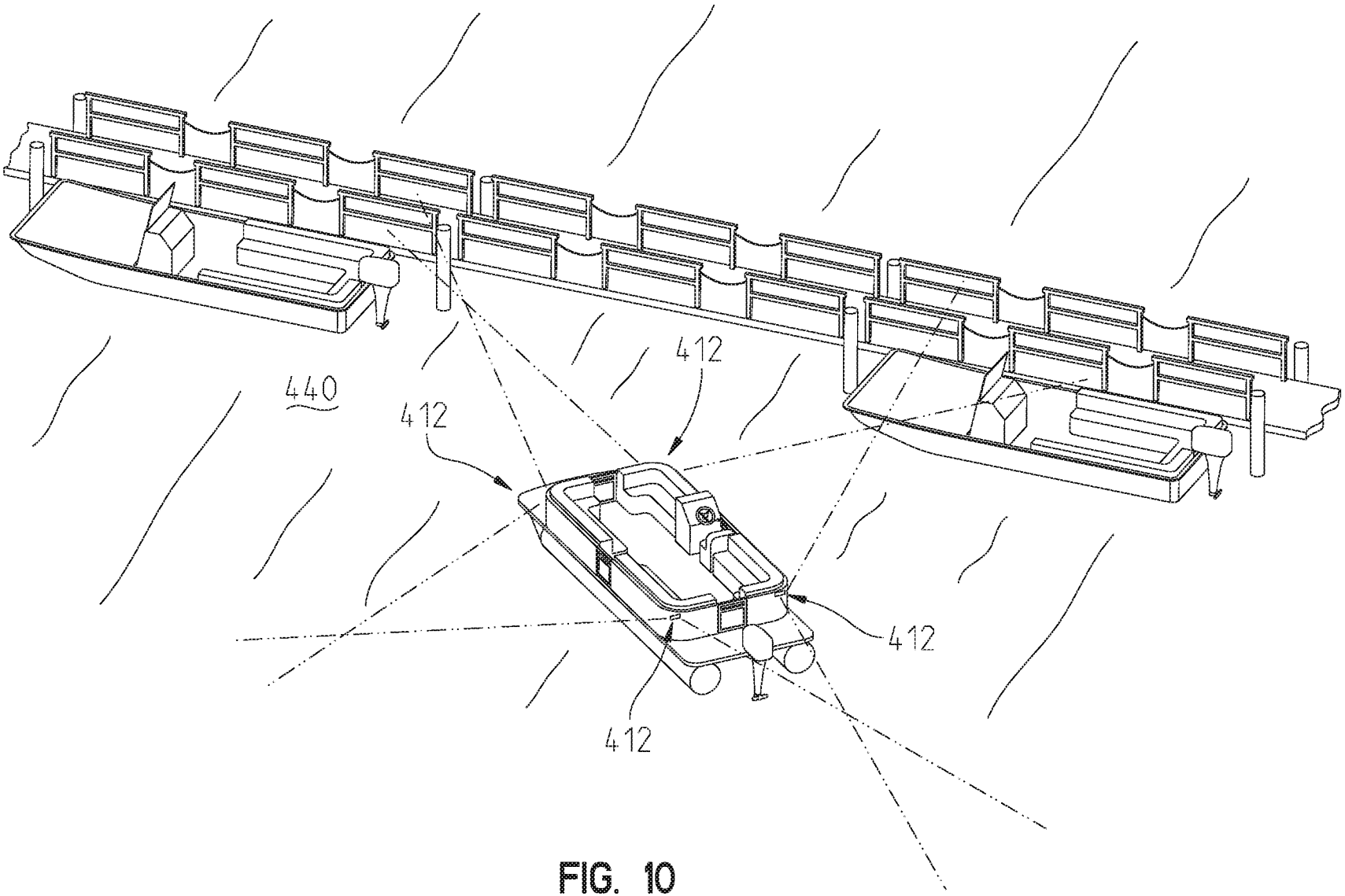
FIG. 10 illustrates an exemplary coverage area of a stereo camera system including a pair of bow stereo cameras and a pair of stern stereo cameras.

Referring to FIGS. 8 and 9, exemplary placement of four stereo cameras 412 are illustrated. The stereo cameras 412 are positioned proximate the bow-starboard corner of pontoon boat 100, the bow-port corner of pontoon boat 100, the stern-starboard corner of pontoon boat 100, and the stern-port corner of pontoon boat 100. Referring to FIG. 10, a representation of a coverage area of the four stereo cameras 412 is illustrated. Additional stereo cameras or other imaging sensors may be positioned at various locations on pontoon boat 100. In embodiments, at least some stereo cameras are oriented such that a line connecting the respective cameras of a stereo camera is angled relative to horizontal, such as vertical, to enhance the ability of the system to recognize horizontal features (dock, boats, and other objects). In embodiments, at least some stereo cameras are oriented such that a lone connecting the respective cameras of a stereo camera is horizontal to enhance the ability of the system to recognize vertical features such as on boat lifts or posts. Exemplary locations include on or affixed to a top rail or portion of barrier 108, on or affixed to deck 104, on or affixed to gate 110, on or affixed to canopy or roof structure, or other suitable locations. In embodiments, pontoon boat 100 includes a bow camera 412 and a stern camera 412, each centered on or positioned near longitudinal centerline 140 of pontoon boat 100. In embodiments, stereo cameras are moveable between a stored position and a use position when the auto-dock feature is in use. As an example, the stereo cameras 412 may be supported by deck 104 on telescoping mounts. The stereo cameras 412 are positioned proximate the deck 104 when the auto-dock feature is not in use ("stored position") and raised relative to the stored position, either automatically or manually, to a raised use position when the auto-dock feature is in use.

Figure 11:
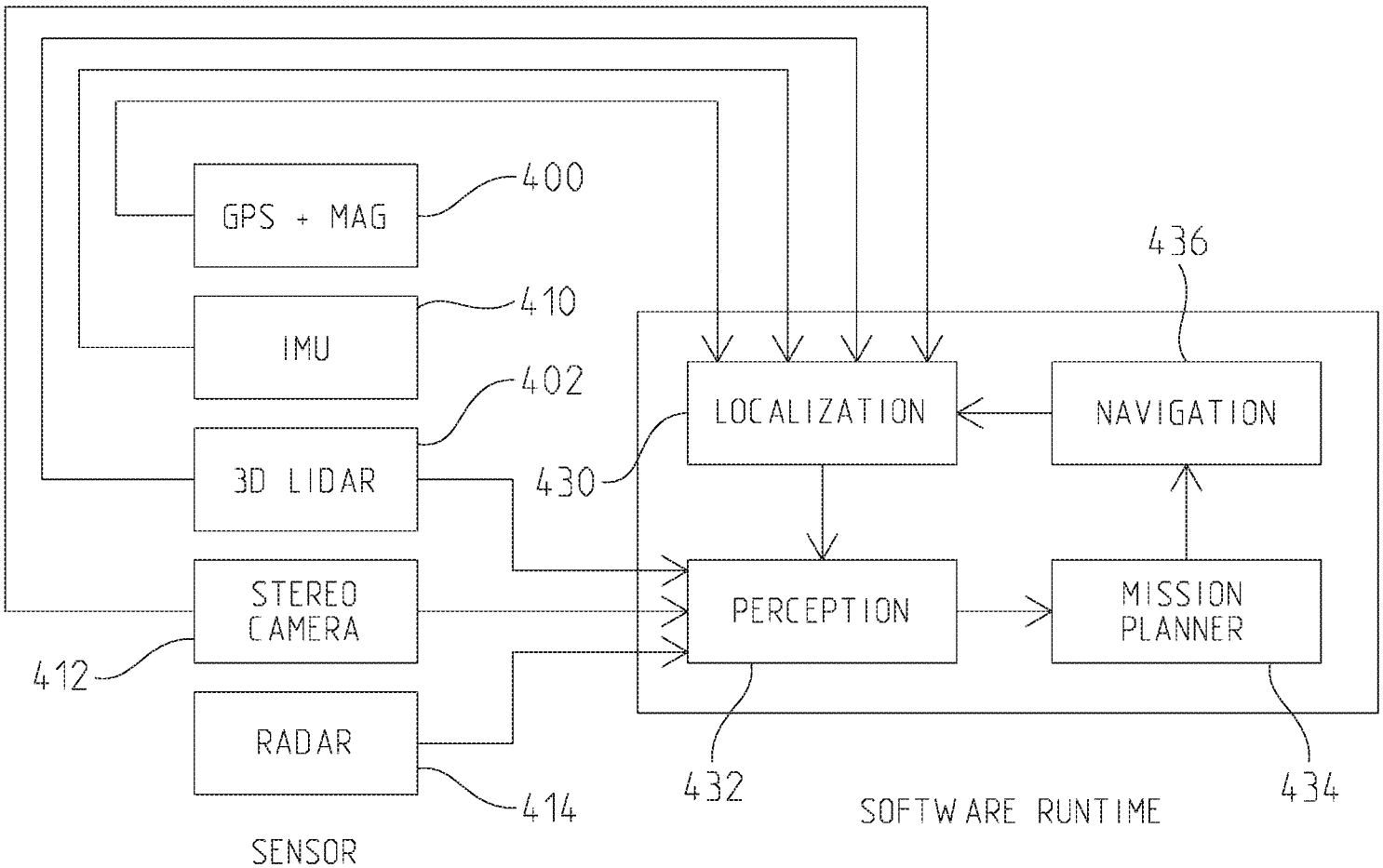
FIG. 11 illustrates an exemplary processing sequence of a controller associated with the pontoon boat.

Referring to FIG. 11, an exemplary processing sequence of auto-dock controller 330 of pontoon boat 100 is illustrated. Auto-dock controller 330 includes a localization component 430, a perception component 432, a mission planner component 434, and a navigation component 436. Localization component 430 receives the inputs from sensors 306, such as from GPS/magnetometer 400, IMU system 410, stereo cameras 412, LIDAR system 402, and radar system 414. Based on those inputs, localization component 430 locates pontoon boat 100 and, in embodiments, corresponding objects in the environment surrounding pontoon boat 100. Obstacles, reference points, goal points, other water vessels, people, docks, buoys, and/or reference objects may be sensed by one or more sensing systems including visual sensors (e.g. cameras), range sensors (e.g. LIDAR, radar, sonar), stereo sensing, projected light visual sensing, beacon detection, sonar, and proximity sensors. In embodiments, localization component 430 includes a sensor fusion algorithm to estimate a three-dimensional pose of pontoon boat 100. The pose of pontoon boat 100 may be determined by one or more of GPS information, IMU information, visual odometry, visual SLAM, visual feature matching, point cloud matching, triangulation with one or more beacons in the environment, INS, and stereo data matching. Based on this information, the local pose estimate of pontoon boat 100 and potential location of obstacles, are provided to perception component 432.

Perception component 432 detects, such as with stereo cameras 412 and LIDAR system 402, and tracks the objects in the environment surrounding pontoon boat 100 (e.g. other boats or swimmers) and a target docking location, such as location 440 (see FIG. 10), with respect to pontoon boat 100. In embodiments, perception component 432 determines a representation of the environmental around boat 100 and semantically labels objects in the representation of the environment like boats and docks based comparisons to learned objects accessible by the logic that have been classified as docks or boats. Based on the location of the objects an audible warning may be sounded with a speaker or horn. Perception component 432 outputs to mission planner component 434 the locations of the obstacles in the surrounding environment and the target docking location with respect to the frame of reference of pontoon boat 100. The target docking location may correspond to a location proximate a dock, a location proximate a boat slip, a location of a boat lift, a portion of a sandbar/beach, or other suitable locations. In embodiments, a good docking location is determined by based on the dimensions of boat 100 to ensure there is ample room to maneuver and dock boat 100, a planar nature of the environmental object identified as a dock, and an openness of the dock area to allow for docking and disembarking from boat 100.

Mission planner component 434 identifies a navigation plan to navigate pontoon boat 100 to the target docking location 440 while avoiding the objects in the environment surrounding pontoon boat 100. In embodiments, mission planner component 434 uses a dynamic graph based on the information from perception component 432 to estimate path and trajectory for pontoon boat 100. Mission planner component 434 outputs navigation waypoints to navigation component 436.

Navigation component 436 controls one or more of outboard prime mover system 308, thruster system 200, and steering system 312 to navigate pontoon boat 100 to location 440. In embodiments, navigation component 436 determines the control of outboard prime mover system 308, thruster system 200, and steering system 312 to navigate pontoon boat 100 along the navigation waypoints output by mission planner component 434. In one example, navigation component 436 utilizes a PID algorithm to provide a smooth movement along the navigation waypoints. In other examples, navigation component 436 utilizes one or more of predictive control, PI, PID, PD, sliding mode control, and/or other suitable control schemes. In embodiments, navigation component 436 adjusts the control of outboard prime mover system 308, thruster system 200, and steering system 312 based on at least one of a sensed weight distribution on boat 100, a wind characteristic, and a current of water 12.

Figure 19:
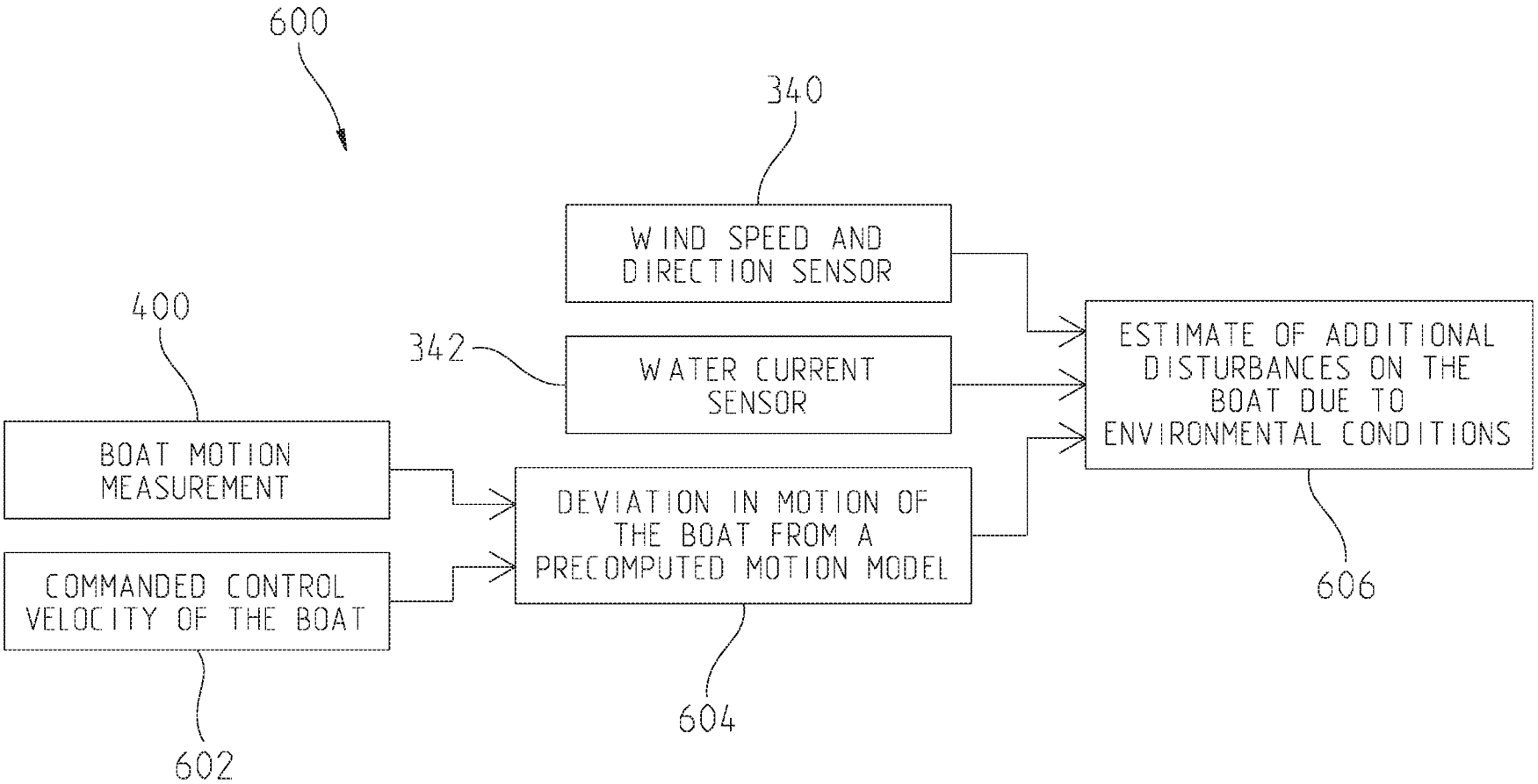
FIG. 19 illustrates a processing sequence for estimating disturbances on the boat due to environmental conditions.

Referring to FIG. 19, an exemplary processing sequence 600 for navigation component 436, in embodiments, is shown. With the GPS sensor 400 a measurement is received of a location of boat 100. Further, the current commanded control velocity of boat 100 is received, as represented by block 602. Based on the position and heading of boat 100 and commanded velocity, a deviation in the motion of boat 100 from an expected location of the boat is determined, as represented by block 604. Additionally, inputs are received from a wind speed and direction sensor 340 and a water current sensor 342. Based on the calculated deviation in boat position 604, the output of wind sensor 340, and the output of water current sensor 342, an estimate of additional disturbances on boat 100 due to environmental conditions may be determined, as represented by block 606.

Figure 20:
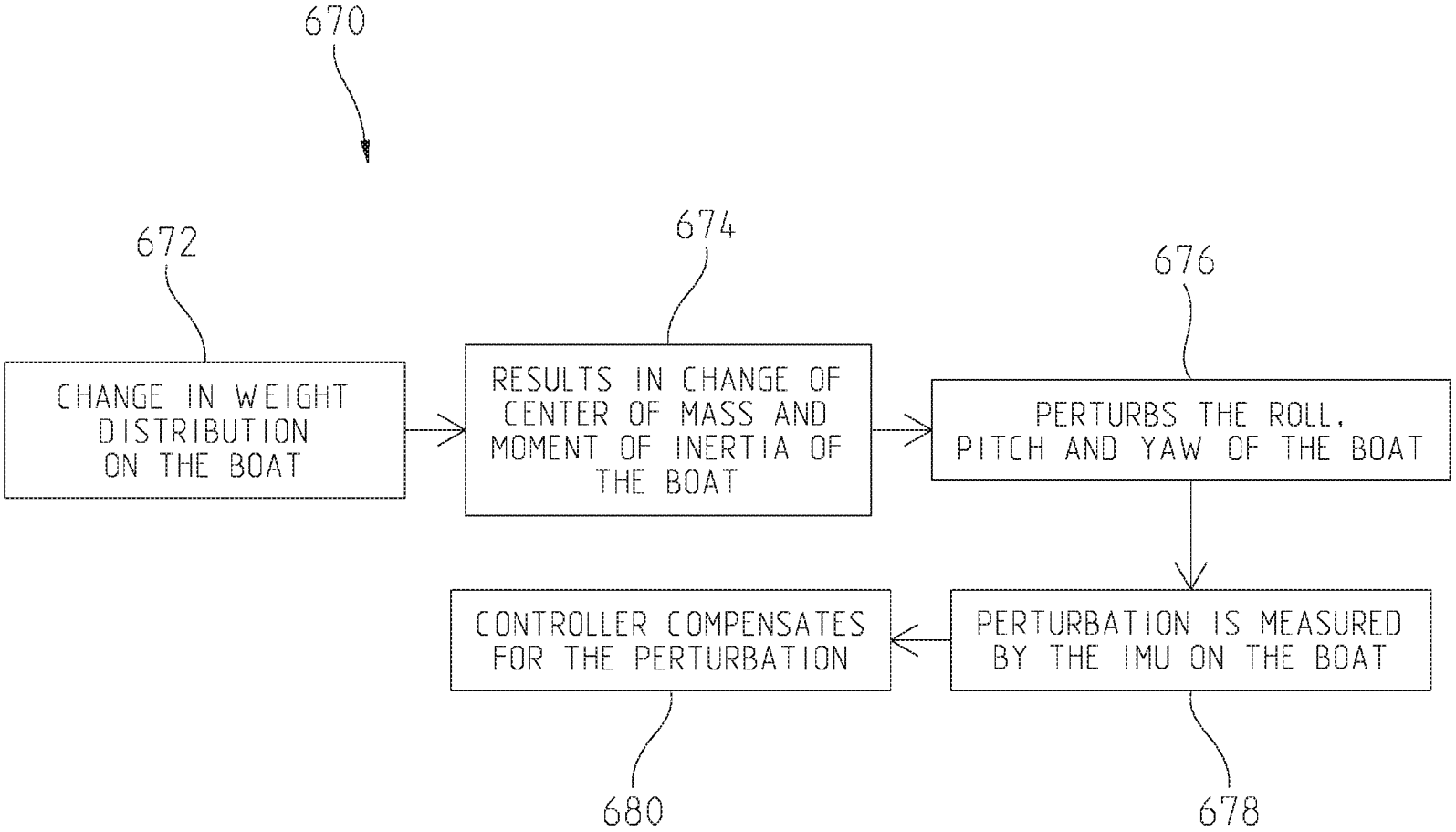
FIG. 20 illustrates a processing sequence for including weight distribution in the determination of command velocity.

Referring to FIG. 20, an exemplary processing sequence 670 for navigation component 436, in embodiments, is shown. Navigation component 436 receives an input from IMU 410 which provides an indication of how boat 100 is sitting in water 12. If the weight supported by boat 100 is not evenly distributed, boat 100 will not sit level in water 12. Further, changes in the weight distribution of the boat 100, such as due to people moving around, results in a change in the center of mass and moment of inertia of boat 100, as represented by blocks 672 and 674. This change perturbs the angle of boat 100 in water 12, as represented by block 676, which is measured by IMU 410, as represented by block 678. These changes in weight distribution changes the response of boat 100 as it moves through water 12. Navigation component 436 includes this change in weight distribution into account when determining the next control velocity command for outboard prime mover system 308, thruster system 200, and steering system 312 to move to a target position.

Figure 12:
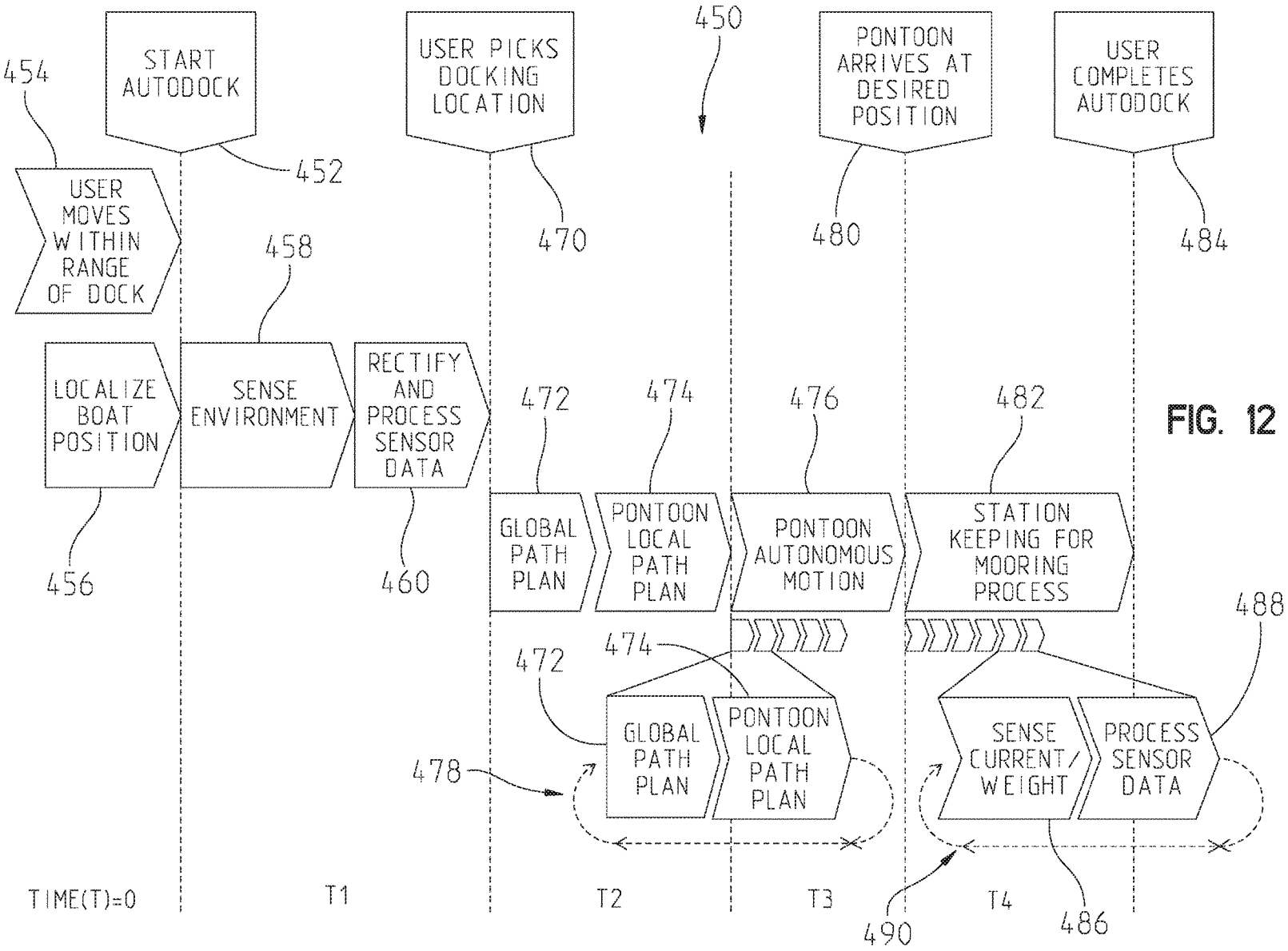
FIG. 12 illustrates a timing diagram a controller associated with the pontoon boat.
Figure 15:
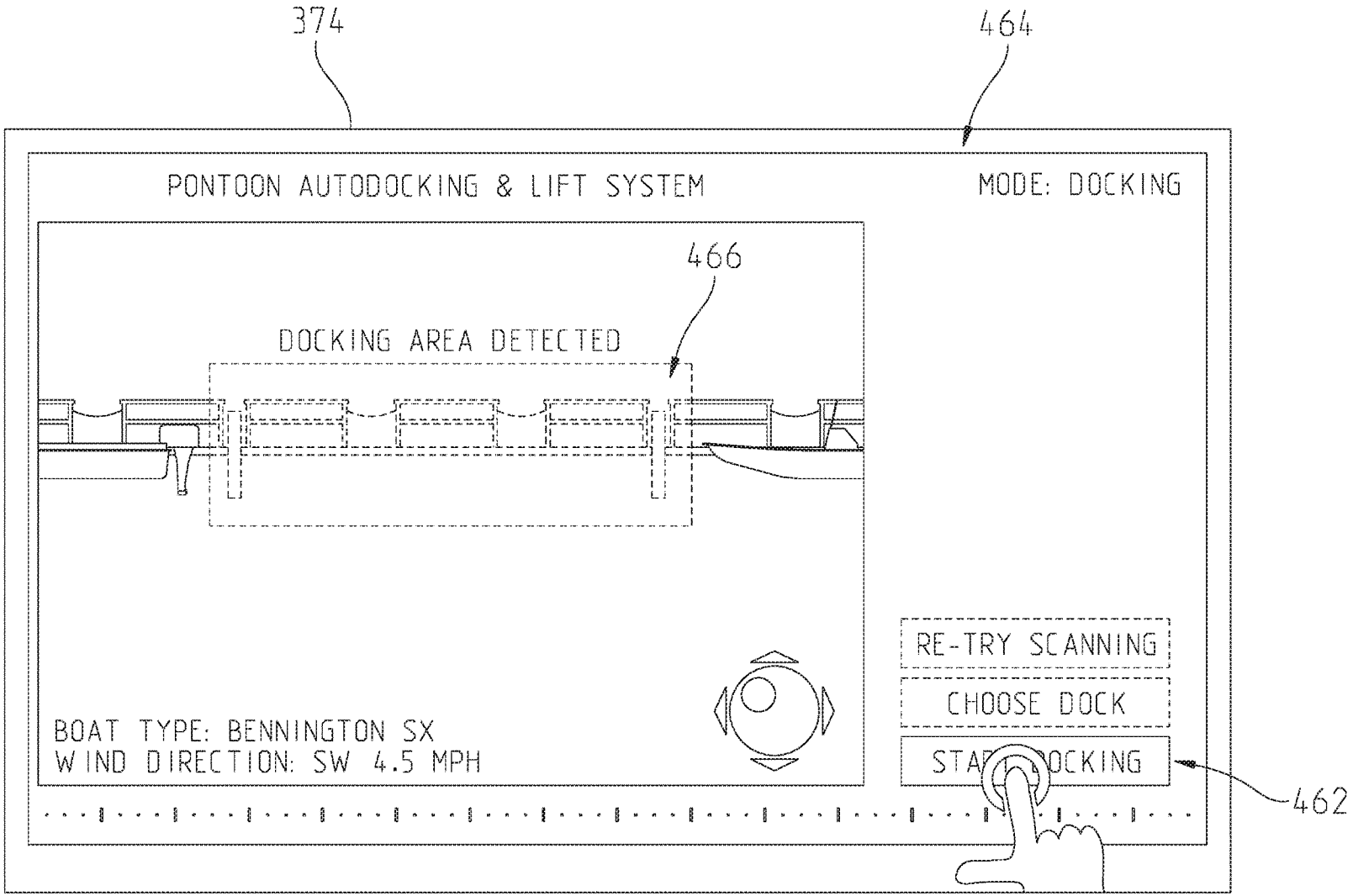
FIG. 15 illustrates a selection screen of a docking interface presented on a display of the auto-docking control device.

Referring to FIG. 12, a timing diagram 450 of an exemplary operation of auto-dock controller 330 is shown. Initially, the auto-dock processing sequence is started, as represented by block 452. Leading up to the start of the auto-dock processing sequence, an operator of pontoon boat 100 moves pontoon boat 100 within range of a dock or other mooring location, as represented by block 454, and auto-dock controller 330 localizes the position of pontoon boat 100, as represented by block 456, with localization component 430. Once the auto-dock processing sequence is begun, auto-dock controller 330 senses the environment around pontoon boat 100, as represented by block 458, and rectifies and processes sensor data from sensors 306, as represented by block 460, with perception component 432. In embodiments, the auto-dock processing sequence is begun in response to the selection of an input 462 provided on an input screen 464 on operator interface 374 (see FIG. 15).

Figure 16:
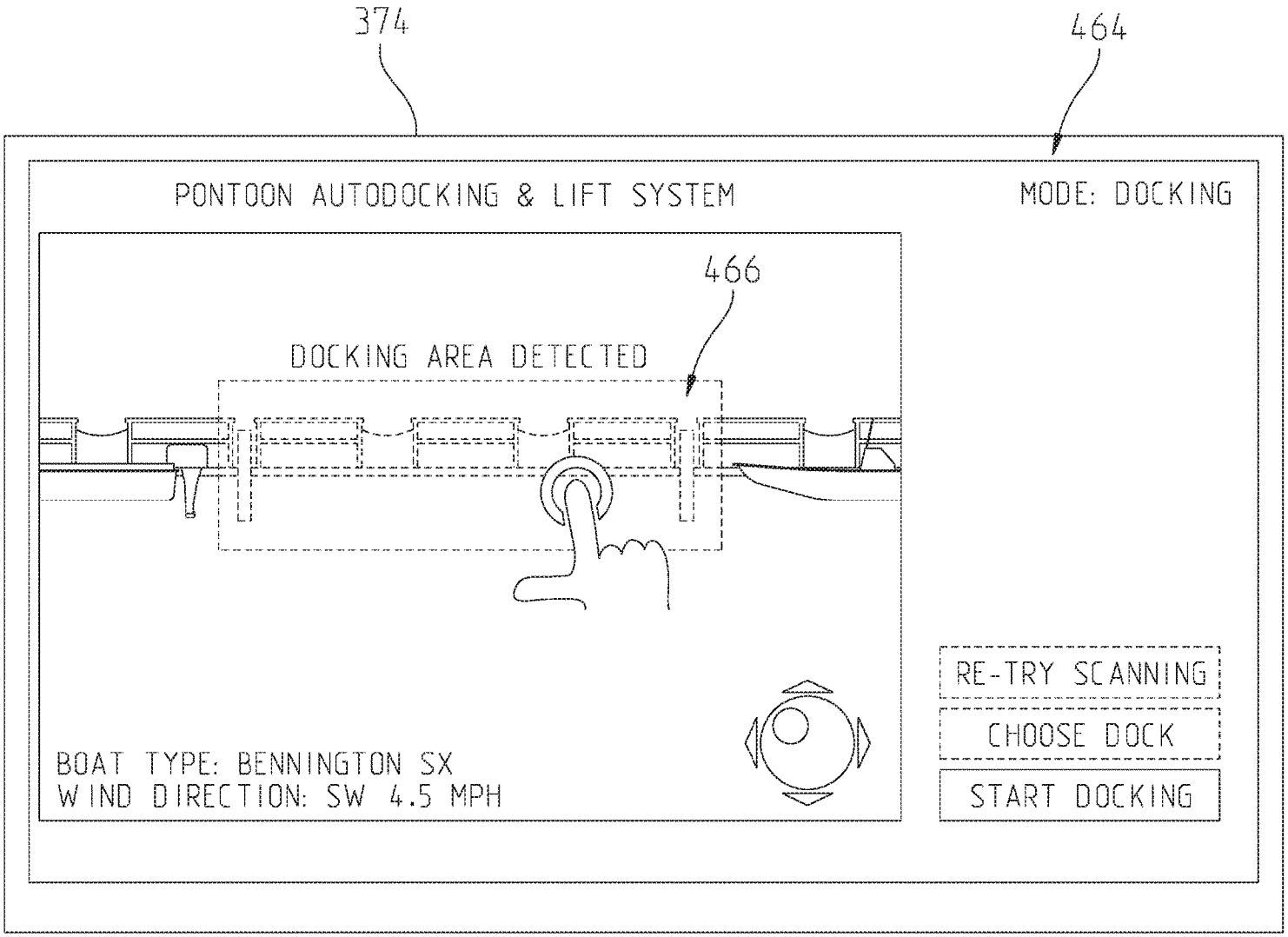
FIG. 16 illustrates a commencement screen of the docking interface presented on the display of the auto-docking control device.

Input screen 464 illustrates a target docking location 466 determined by auto-dock controller 330 based on the size of pontoon boat 100 and a corresponding sized area proximate the dock. The operator confirms the displayed target docking location by selecting it, as represented by block 470 in FIG. 12 and illustrated in FIG. 16.

Once the docking location 466 is selected, auto-dock controller 330 begins determining the path and trajectory of pontoon boat 100, as represented by blocks 472 and 474, and controlling one or more of outboard prime mover system 308, thruster system 200, and steering system 312 to move pontoon boat 100 to the docking location, as represented by block 476. The path and trajectory of pontoon boat 100 is updated multiple times during the movement of pontoon boat 100 to the docking location 466 as represented by loop 478. In embodiments, block 472 is a global path and trajectory to move pontoon boat 100 from its current position to the docking location and block 474 is a local path and trajectory to move pontoon boat 100 to the next waypoint along the global path and trajectory. In embodiments, the auto-dock controller 330 may receive an input from a sensor monitoring an area in front of a control panel of boat 100. In embodiments, the auto-dock controller 330 may fail to initiate or stop an ongoing auto-dock procedure if an operator is not sensed being in front of the control panel of the boat 100. In embodiments, a switch is provided as part of the control panel or at another location on pontoon boat 100 and the auto-dock controller 330 may fail to initiate or stop an ongoing auto-dock procedure based on the status of the switch. In one embodiment, the switch is a deadman switch which requires the user to apply active force to keep the switch closed. If the user stops applying force, the switch opens and the auto-dock procedure is stopped. Further, an audio, visual, and/or tactile feedback can be provided. In one embodiment, the switch is a liveman switch which requires a user to apply active force to keep the switch closed, but if force over a threshold amount is applied, the switch opens. Similar to the deadman switch, if the user does not apply active force, the switch opens. If the user stops applying force or applies excessive force, the auto-dock procedure is stopped.

Figure 17:
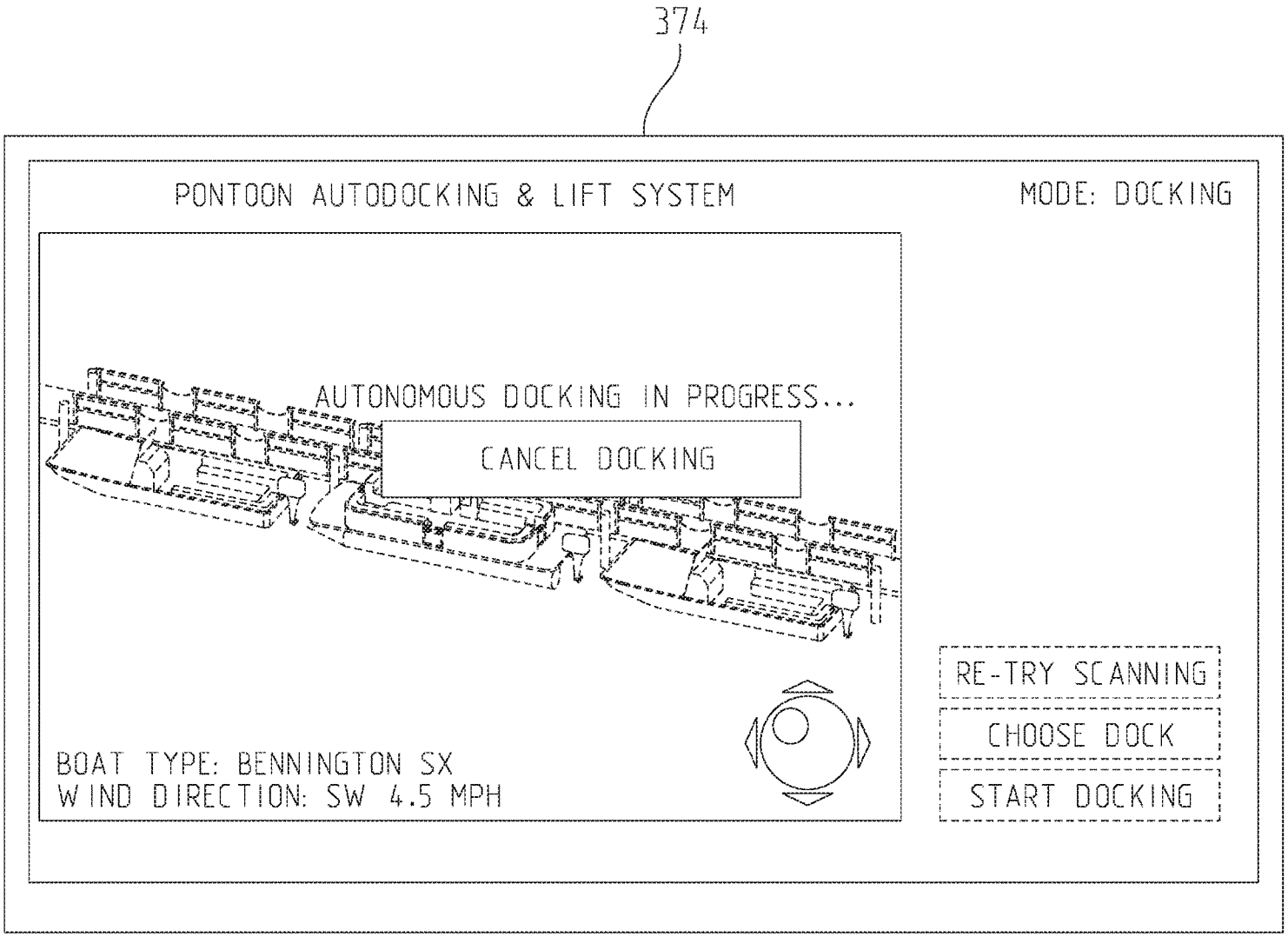
FIG. 17 illustrates a progression screen of the docking interface presented on the display of the auto-docking control device.
Figure 18:
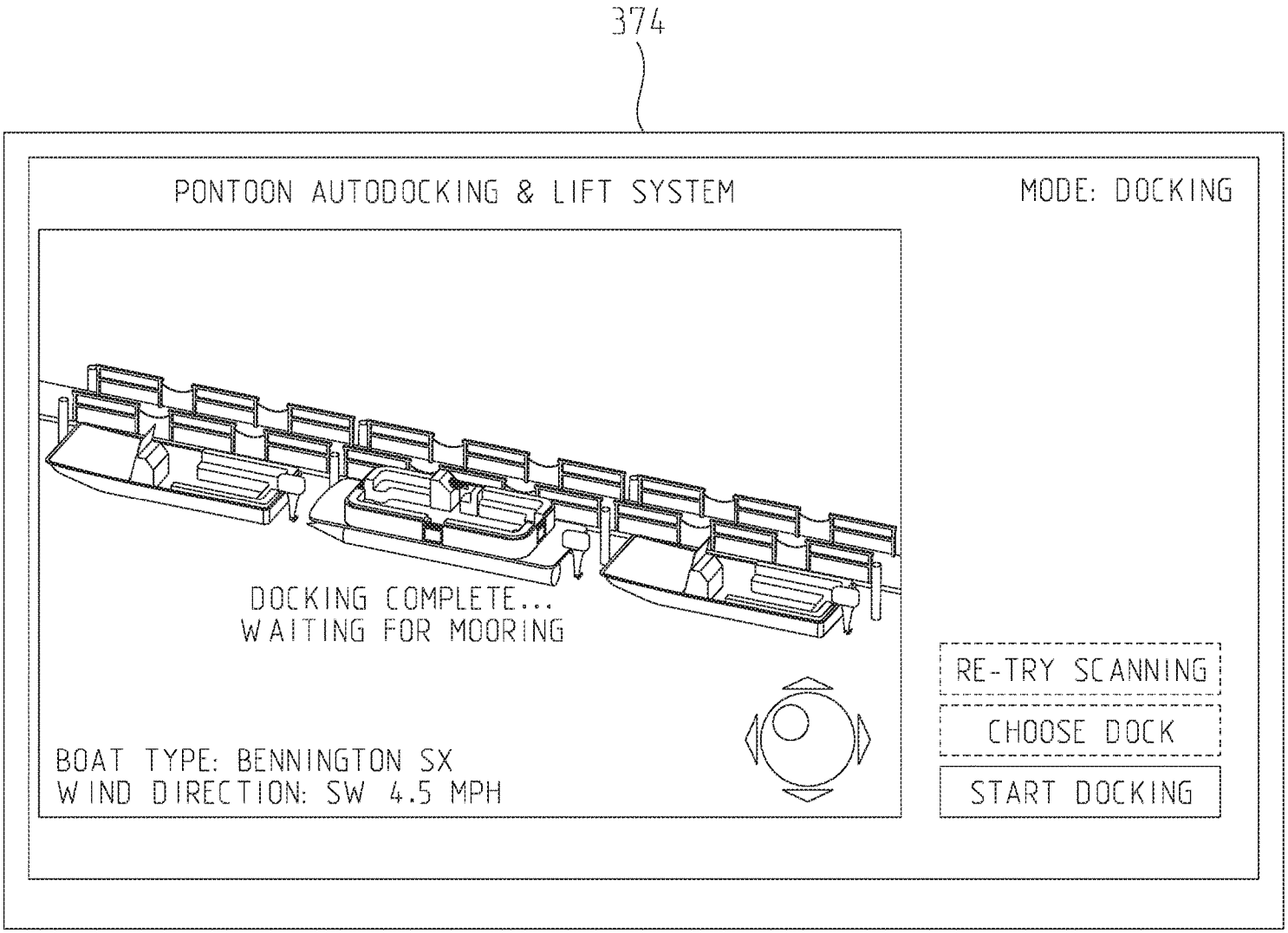
FIG. 18 illustrates a completion screen of the docking interface presented on the display of the auto-docking control device.

Referring to FIG. 17, during the movement of pontoon boat 100 to the docking location 466, remote operator device 300 presents feedback to the operator of the position of pontoon boat 100. Further, screen 464 presented on operator interface 374 includes a cancel docking input region which if selected would cancel the auto-docking process. As shown in FIG. 18, once pontoon boat 100 is in the docking position, screen 464 provides a message to the operator that docking is complete and pontoon boat 100 should be moored to the dock or other mooring location. In embodiments, one or both of remote operator device 300 and operator interface 374 provide one or more of audio, visual, and tactile feedback to the user of when pontoon boat 100 is in the docking position, when an obstacle is near, or other specified scenarios.

Returning to FIG. 12, block 480 represents when pontoon boat 100 is positioned in the confirmed target docking location 466. Once in the confirmed target docking location 466, auto-dock controller 330 operates to maintain pontoon boat 100 in a mooring configuration at the docking location 466 until the auto-docking process is ended, as represented by blocks 482 and 484. In the mooring configuration, the pontoon boat 100 remains essentially stationary to allow an operator to tie up, or moor the vessel to the docking structure. In the case of a dock or slip the system may maintain a position of the boat 100 relative to the dock or slip sides. In the case of a boat lift, the system may maintain a center of mass of boat 100 between the lifts. During this process, remote operator device 300 is monitoring the weight of pontoon boat 100 and the current of the water pontoon boat 100 is positioned in, as represented by block 486. This data is processed to update requirements of thruster system 200 to maintain the position of pontoon boat 100 relative to the dock as represented by block 488. This process is repeated until the auto-dock process ends, as represented by loop 490. In embodiments, the mooring configuration process ends automatically after a certain amount of time has passed, or it may be controlled via an operator device 300 input, by the operator, once the pontoon boat 100 has been successfully moored.

It is also contemplated that the logic of the mooring configuration process could be utilized outside of a docking process, in which an operator could configure a pontoon boat 100 to simply stay in a stationary position for a period of time in open water to, for example, allow another aquatic vessel to tie up to it, or allow a swimmer to board the pontoon boat 100. A mooring configuration process utilized in open water provides a type of virtual anchor ("station keeping"). In embodiments, the system maintains the position and orientation of pontoon boat 100 in the water (minimize translational and rotational movement). The system compensates for wind, water current, momentum, and water disturbances (such waves caused by passing aquatic vessels). In embodiments, when an operator through remote operator interface 374 or operator interface 360 manipulates an input to direct motion of the pontoon boat 100, the system responds accordingly and instead of maintaining a zero velocity or position, it attempts to match the user's desired input (like turn, translate, etc) while compensating for disturbances. When the user stops directing motion through remote operator interface 374 or operator interface 360, the system reverts to the station keeping (zero velocity/zero movement).

In embodiments, the systems disclosed herein provide alerts to an operator moving the boat 100 manually of proximate objects. Exemplary alerts include audio, visual, and tactile alerts. In embodiments, the systems disclosed herein modify a movement of boat 100 to prevent a collision with a sensed object.

Figure 13:
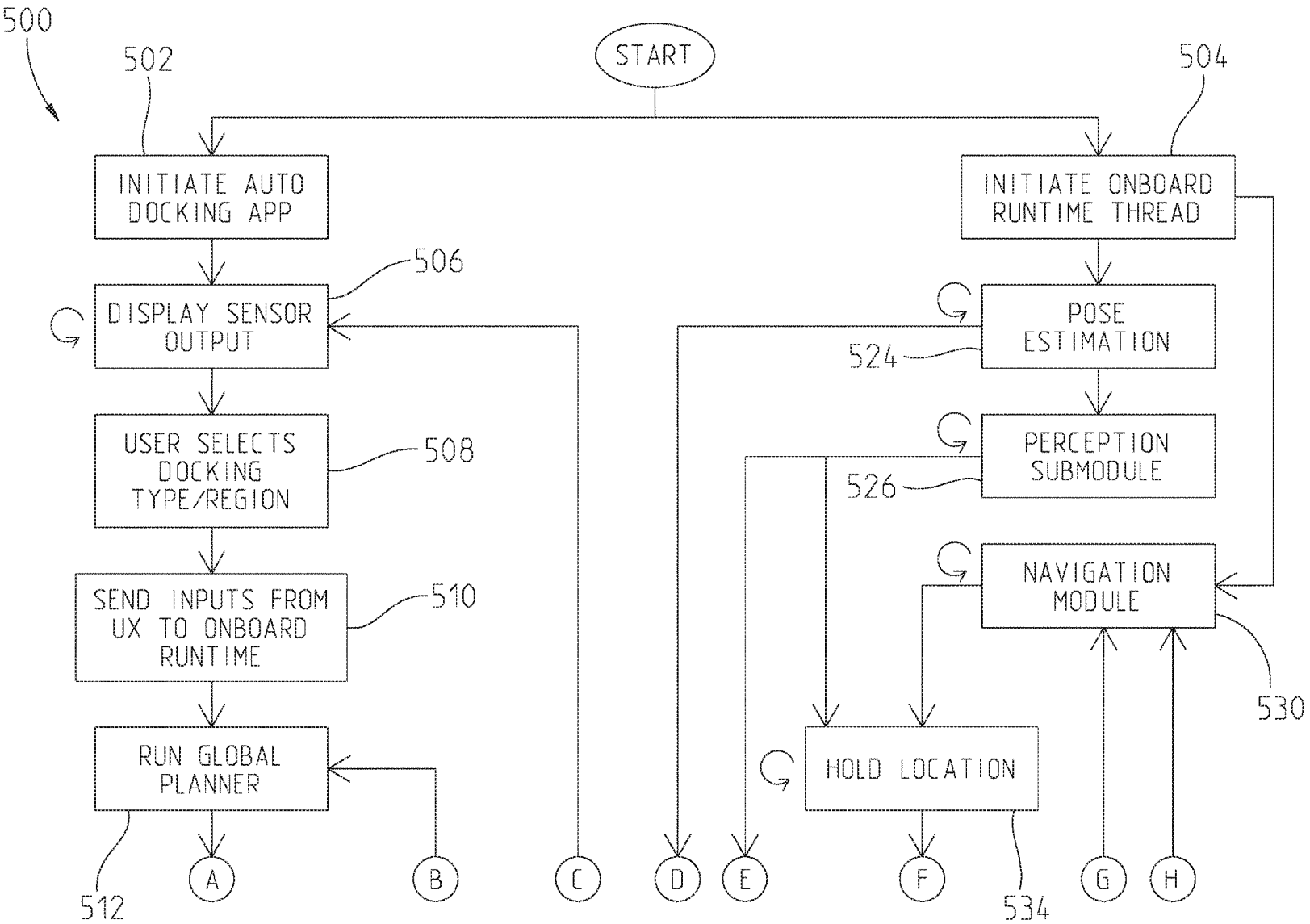
FIGS. 13 and 13A illustrates another exemplary processing sequence of a controller associated with the pontoon boat.

Referring to FIG. 13, an exemplary processing sequence 500 is shown. The auto-docking process is started with auto-dock I/O controller 382 on remote operator device 300 by initiating an auto-dock software application with operator interface 374 of remote operator device 300, as represented by block 502. This also results in auto-dock controller 330 of pontoon boat 100 beginning to execute, as represented by block 504.

On operator interface 374 of remote operator device 300, the output of various sensors 306 are displayed and updated, as represented by block 506. An operator of remote operator device 300 confirms a presented target docking region or type, as represented by block 508. These inputs are sent to auto-dock controller 330 of pontoon boat 100 and a global planner determines proposed movements of pontoon boat 100 to the selected location, as represented by block 512. The plan is output to the operator on operator interface 374, as represented by block 514. The operator can accept the proposed plan or change the proposed plan, as represented by block 516. If the operator is making a change of region, control returns to block 512, as represented by block 518. If the operator is making a change of type, control returns to block 506. Exemplary changes of type include switching from a dock to a boat slip or lift. Here an operator would also be able to select how a pontoon boat will be oriented when docked. Examples of docking orientations include but are not limited to port side parallel, starboard side parallel, aft first (backed in), bow first (straight in), aft/bow port/starboard quarter moored, etc. If the operator accepts the plan, the plan is provided to a local planner of mission planner component 434 of auto-dock controller 330 of pontoon boat 100, as represented by block 520.

The local planner of mission planner component 434 of auto-dock controller 330 determines and updates the movement of pontoon boat 100 towards the selected location and the waypoints there between, as represented by block 522. The local planner of mission planner component 434 of auto-dock controller 330 receives inputs from a pose estimator of localization component 430 of auto-dock controller 330 which determines and updates the location and orientation of pontoon boat 100, as represented by block 524, and from perception component 432 of auto-dock controller 330 which determines and provides updates on the environment surrounding pontoon boat 100, as represented by block 526.

The local planner of mission planner component 434 of auto-dock controller 330 outputs instructions to navigation component 436 of auto-dock controller 330, as represented by block 530. Further, auto-dock controller 330 determines if pontoon boat 100 is at the desired location and if so controls pontoon boat 100 to maintain the desired location, as represented by blocks 532 and 534. The local planner of mission planner component 434 of auto-dock controller 330 also provides updates to auto-dock I/O controller 382 of remote operator device 300 which are displayed on operator interface 374, as represented by block 534.

The local planner of mission planner component 434 of auto-dock controller 330 also monitors for user input to stop movement of pontoon boat 100, as represented by block 536. Exemplary inputs include a selection through operator interface 374 to pause or end the docking, the pressing of an estop input, and manual input to move pontoon boat 100 through operator console 190 of pontoon boat 100.

In embodiments, the auto-dock controller 330 first confirms that outboard motor 170 is in a raised trim-up position. In one example, this confirmation is received as an operator input on operator interface 374 of remote operator device 300. In another example, this confirmation is received by checking a trim sensor that monitors a trim position of outboard motor 170. In yet another example a controller of outboard motor provides a signal to remote operator device of a trim position of outboard motor 170.

Figure 13A:
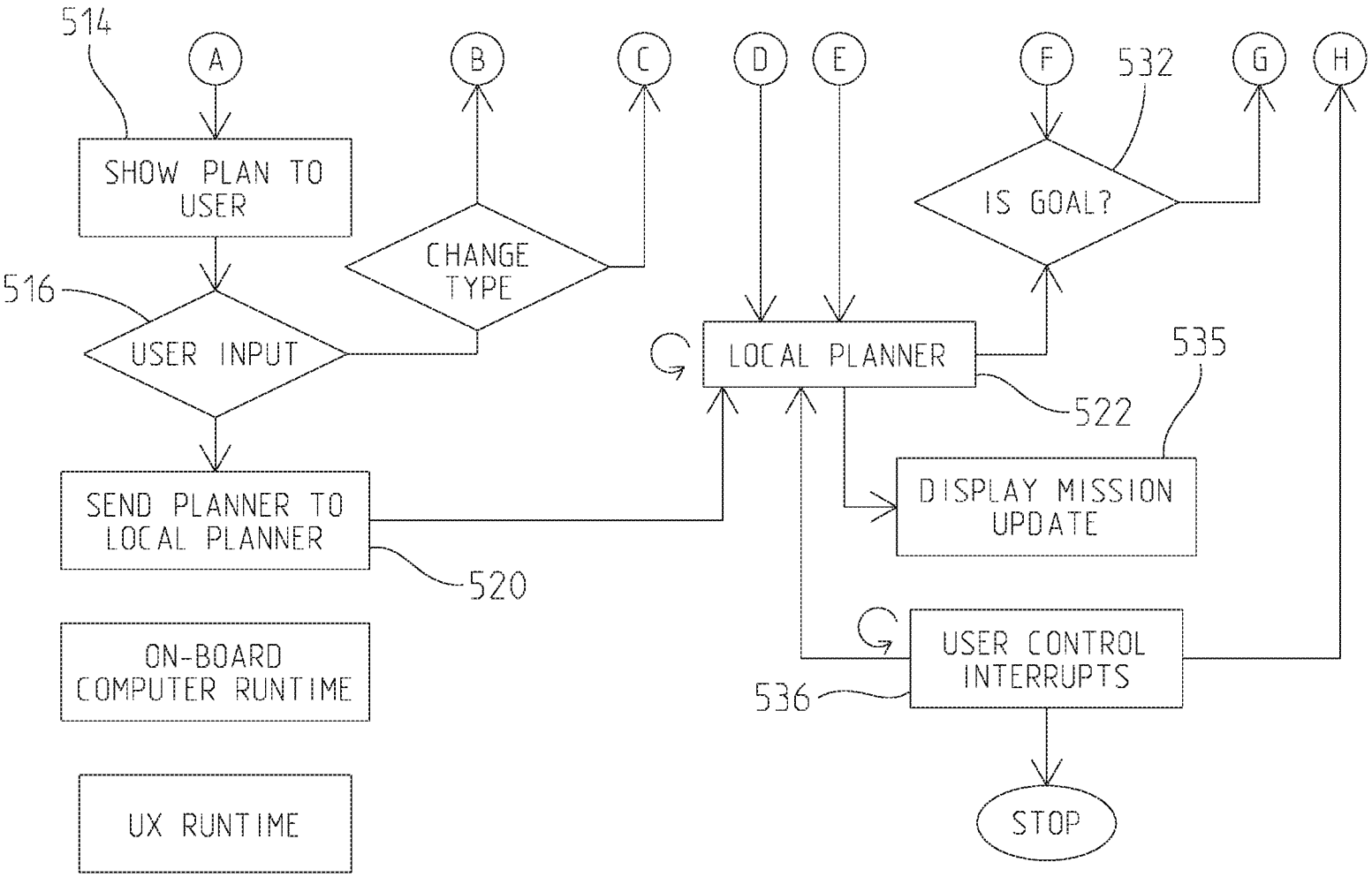
Figure 13B:
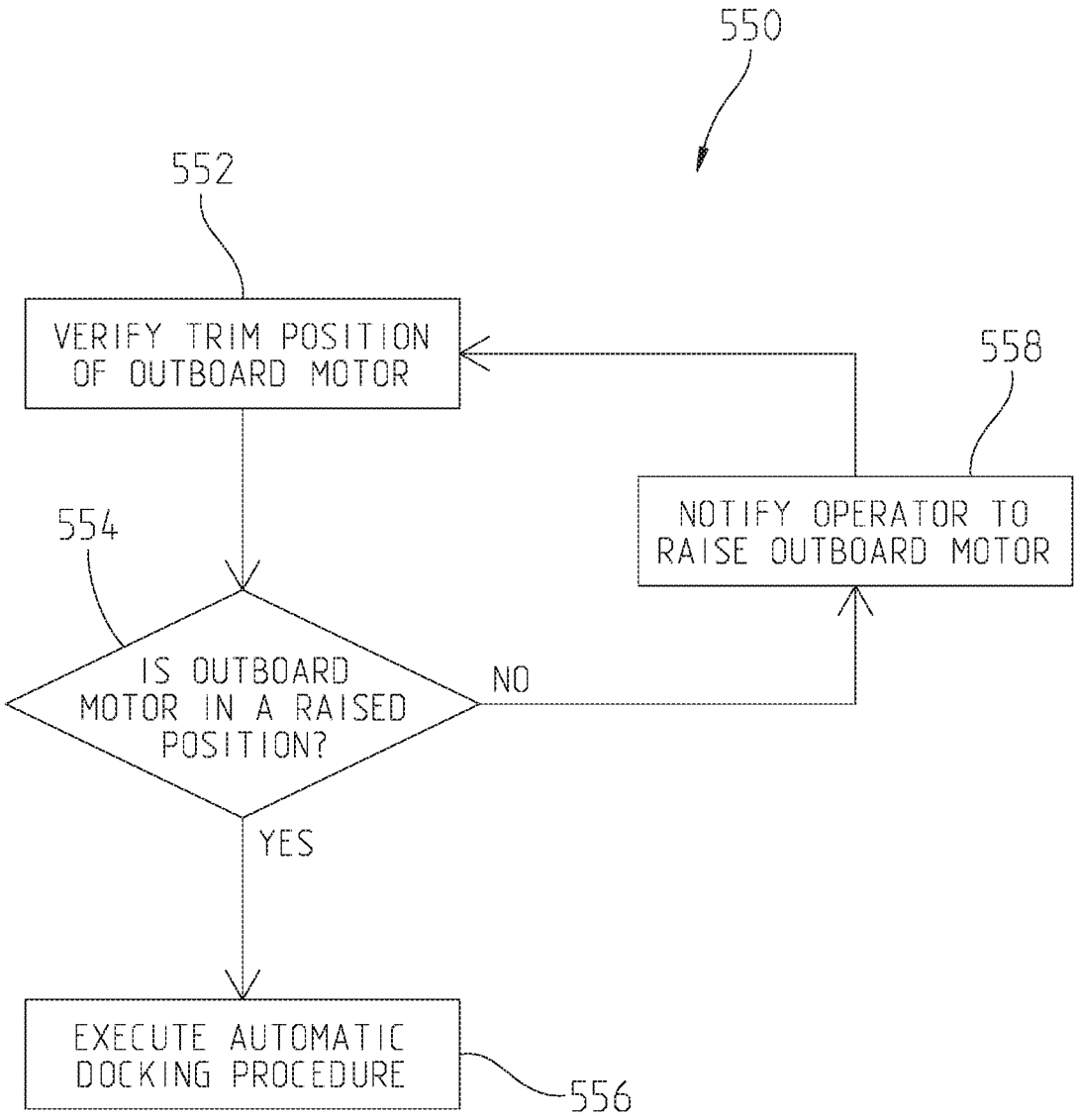
FIG. 13B illustrates yet a further exemplary processing sequence of a controller associated with the pontoon boat.

Referring to FIG. 13A, an exemplary processing sequence 550 is shown. Auto-dock controller 330 verifies the trim position of the outboard motor, as represented by block 552. The auto-dock controller 330 determines whether the outboard motor is in the raised trim-up position, as represented by block 554. If the outboard motor is in the raised trim-up position then auto-dock controller executes the auto-dock procedure, as represented by block 556. If the outboard motor is not in the raised trim-up position then auto-dock controller provides a notification to the operator to raise the outboard motor, as represented by block 556. Exemplary notifications include a visual cue on operator device 300, an audible cue such as a horn or alarm, and/or a tactile cue.

In embodiments, the disclosed systems may further include a beacon system with one or more fixed beacon on the mooring implement (dock/lift/slip) which with another sensor on the boat 100 can triangulate position. Further, the target mooring implement may be equipped with a beacon/fiducial/marker to enable the sensing system of boat 100 to distinguish the target from the environment and/or locate the position of the target. Alternatively, the location of boat 100 may be sensed with a sensing system associated with the mooring implement that locates the boat 100 and communicates position information to the boat 100. The boat system may use the communicated position information to assist in movement of the boat 100.

The disclosed embodiments are capable detecting or determining various conditions including (a) weather conditions: no wind, slight wind, moderate wind, heavy wind, no water current, slight current, moderate current, heavy current, no rain, light rain, heavy rain, fog, overcast, sunshine at morning, noon, and night, and night-time; (b) surrounding conditions: shallow water, shoreline, people in the water, people out of the water, stationary boats at a dock, stationary boats, similar boats moving at a dock, similar boats moving, small watercraft, large watercraft, foreign objects (hazards) in water, and foreign objects (hazards) along dock; (c) detection of mooring implement features: tie-down feature, modified boat lift, unmodified boat lift; (d) dock types: shorter than boat, longer than boat; perpendicular slip; angled slip; and (e) boat conditions: list amount (due to wind, water, and/or people), list rate (due to wind, water, and/or people), approach speed, approach angle, approach distance.

In an exemplary embodiment, a pure assist (ADAS like) control is provided by the disclosed systems. At a first level of the pure assist control, an operator of the boat 100 provides input of a desired movement of boat 100, such as through a joystick input. Sensors provide information related to the location of boat 100 relative to surrounding objects and the system alerts the operator when boat 100 is getting close to a detected obstacle. Further, the system may provide feedback to the operator of the distance to the mooring implement, such as the dock. The feedback may be audio, visual, and/or tactile. The feedback may provide a numeric measurement or a qualitative indication of the distance. At a second level of the pure assist control, the system will execute a station keeping procedure to compensate for wind and current. The station keeping will maintain the position of boat 100 while it is being secured to the mooring implement. At a third level of the pure assist control, the system will prevent collisions with other objects. Collisions may be prevented by altering a course of travel of boat 100 or station keeping.

In an exemplary embodiment, an assistive docking control is provided by the disclosed systems. At a first level of the assistive docking control, an operator clicks/touches area on a screen of the user interface to indicate where boat should dock. The operator also specifies how boat should dock (head-on, parallel, boat lift, etc). The operator must touch/hold some kind of deadman switch and minimum environmental conditions must be satisfied for the system to continue. The system notifies and kicks out if the deadman switch is released, or system unable to achieve desired motion (due to unseen obstruction, high wind, high current, poor visibility, etc.). The operator may be the only person looking for obstacles and hazards. The system moves boat 100 to target location in motion selected by operator. At a second level of the assistive docking control, the operator specifies intended action (parallel, head-on, boat lift, etc) and is presented with viable options detected by system. The operator confirms/selects option for target location. The system detects obstacles and differentiates dock from obstacles. Further, the system can determine if boat 100 will fit in the target location. The system waits for detected dynamic obstacles if they present hazard. At a third level of the assistive docking control, the operator is given options for action along with providing target confirmation (system can automatically detect boat lift, parallel, head-on, etc). The operator may step away from deadman switch for a predetermined amount of time, such as a few seconds. The operator may provide a voice command to the system to disengage assist.

The illustrated embodiments are described with reference to pontoon boat 100. The scope of the described embodiments is not limited to the specific application of pontoon boats, but rather may be implemented on any type of aquatic vessels, including but not limited to pontoon boats, single hull boats, and other suitable aquatic vessels. Further, the illustrated embodiments illustrate the application of parking a boat along a side of a dock, such that one of the port or starboard sides are positioned along the dock. The described embodiments are not limited to this orientation of the boat, but rather may be used to position the boat in an desired orientation relative to an environmental object, such as docks, piers, mooring points and other objects, such that the boat may be positioned in a desired orientation relative to a dock, may be pulled into a slip, may be positioned on a lift, may be located relative to a mooring point, and other positions relative to an environmental object.

While this invention has been described as having exemplary designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

We claim:

1. A pontoon boat which is positionable relative to a mooring implement, the pontoon boat comprising:

a plurality of pontoons;

a deck supported by the plurality of pontoons, the deck having an outer perimeter;

a thruster system including at least one water inlet in the plurality of pontoons and a plurality of water outlets in the plurality of pontoons;

a plurality of sensors supported by the plurality of pontoons; and at least one controller operatively coupled to the plurality of sensors and the thruster system, the at least one controller configured to:

automatically identify a target docking location comprising the mooring implement based on input from the plurality of sensors;

receive user input to accept the automatically identified target docking location; and position the pontoon boat relative to the target docking location with the thruster system based on input from the plurality of sensors.

2. The pontoon boat of claim 1, wherein the plurality of pontoons includes a port side pontoon, a starboard side pontoon, and a third pontoon positioned between the port side pontoon and the starboard side pontoon, each of the plurality of pontoons extending longitudinally under the deck.

3. The pontoon boat of claim 2, wherein the at least one water inlet and the plurality of water outlets are provided in the third pontoon.

4. The pontoon boat of claim 1, wherein the plurality of water outlets includes a port-bow outlet.

5. The pontoon boat of claim 1, wherein the plurality of water outlets includes a port-stem outlet.

6. The pontoon boat of claim 1, wherein the plurality of water outlets includes a starboard-bow outlet.

7. The pontoon boat of claim 1, wherein the plurality of water outlets includes a starboard-stern outlet.

8. The pontoon boat of claim 1, wherein the thruster system further includes at least one fluid pump which pumps fluid from the at least one inlet towards at least one of the plurality of outlets.

9. The pontoon boat of claim 1, further comprising an outboard motor positioned at a stern of the pontoon board.

10. The pontoon boat of claim 1, wherein the mooring implement is a dock.

11. The pontoon boat of claim 1, wherein the mooring implement is a lift.

12. The pontoon boat of claim 1, wherein the mooring implement is a slip.

13. The pontoon boat of claim 1, wherein the plurality of sensors includes a plurality of stereo cameras.

14. The pontoon boat of claim 13, wherein a first stereo camera of the plurality of stereo cameras is oriented to enhance detection of horizontal features.

15. The pontoon boat of claim 1, wherein the plurality of sensors includes a LIDAR system.

16. A method of automatically docking a pontoon boat relative to a mooring implement, the method comprising:

automatically identifying, based on sensor data, a target docking location proximate the mooring implement;

receiving user input to accept the automatically identified target docking location;

activating a thruster system provided in at least one pontoon of the pontoon boat;

automatically controlling a movement of the pontoon boat to the target docking location; and providing an indication when the pontoon boat is in the target docking location.

17. The method of claim 16, wherein the step of activating the thruster system follows the further steps of:

presenting a representation of the target docking location to an operator; and receiving, from the operator, the user input to accept the target docking location.

18. The method of claim 17, wherein the step of presenting the representation of the target docking location to the operator includes the step of displaying the representation on a handheld operator device which communicates with the pontoon boat over a network.

19. The method of claim 16, further comprising the step of maintaining a position of the pontoon boat in the target docking location with the thruster system.

20. The method of claim 16, wherein the step of receiving sensor data regarding the target docking location proximate the mooring implement includes the step of receiving position information from a sensor associated with the mooring implement.

21. The method of claim 16, wherein the step of receiving sensor data regarding the target docking location proximate the mooring implement includes the step of receiving information regarding a fiducial associated with the mooring implement.

22. A method of automatically docking an aquatic vessel having an outboard motor relative to a mooring implement, the method comprising:

receiving sensor data regarding a target docking location proximate the mooring implement;

activating a thruster system of the aquatic vessel to propel the aquatic vessel;

determining the outboard motor of the aquatic vessel is in a raised position;

in response to determining the outboard motor is in the raised position, automatically controlling a movement of the aquatic vessel to the target docking location; and providing an indication when the aquatic vessel is in the target docking location.

23. The method of claim 22, wherein the step of activating the thruster system follows the further steps of:

presenting a representation of the target docking location to an operator; and receiving confirmation from the operator of a selection of the target docking location.

24. The method of claim 23, wherein the step of presenting the representation of the target docking location to the operator includes the step of displaying the representation on a handheld operator device which communicates with the aquatic vessel over a network.

25. The method of claim 22, further comprising the step of maintaining a position of the aquatic vessel in the target docking location with the thruster system.

* * * * *